US011523721B2

(12) United States Patent
Lee et al.

(10) Patent No.: US 11,523,721 B2
(45) Date of Patent: Dec. 13, 2022

(54) VACUUM CLEANER

(71) Applicant: LG Electronics Inc., Seoul (KR)

(72) Inventors: Youngjoo Lee, Seoul (KR); Jungmin Ko, Seoul (KR); Soohan Eo, Seoul (KR); Kietak Hyun, Seoul (KR); Inkyu Hwang, Seoul (KR); Sangchul Lee, Seoul (KR); Jonguk Her, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/276,122

(22) PCT Filed: Sep. 16, 2019

(86) PCT No.: PCT/KR2019/011944

§ 371 (c)(1),
(2) Date: Mar. 12, 2021

(87) PCT Pub. No.: WO2020/055216

PCT Pub. Date: Mar. 19, 2020

(65) Prior Publication Data

US 2022/0047132 A1 Feb. 17, 2022

(30) Foreign Application Priority Data

Sep. 14, 2018 (KR) ..... 10-2018-0110019
Sep. 14, 2018 (KR) ..... 10-2018-0110021
(Continued)

(51) Int. Cl.
*A47L 9/10* (2006.01)
*A47L 9/16* (2006.01)
(Continued)

(52) U.S. Cl.
CPC ..... *A47L 9/108* (2013.01); *A47L 5/24* (2013.01); *A47L 9/127* (2013.01); *A47L 9/1683* (2013.01); *A47L 9/322* (2013.01)

(58) Field of Classification Search
CPC . A47L 5/24; A47L 9/106; A47L 9/108; A47L 9/127; A47L 9/1683; A47L 9/322
(Continued)

(56) References Cited

U.S. PATENT DOCUMENTS 2,581,949 A 1/1952 Gerber
2,645,303 A 7/1953 Meyerhoefer
(Continued)

FOREIGN PATENT DOCUMENTS

CN 1511496 A 7/2004
CN 1545972 A 11/2004
(Continued)

OTHER PUBLICATIONS

EP1136028 with Translation, Hayashi, Electric Vacuum Cleaner, Sep. 26, 2001, p. 1-64, (Year: 2001).*
(Continued)

*Primary Examiner* — Orlando E Aviles
*Assistant Examiner* — Sidney D Hohl
(74) *Attorney, Agent, or Firm* — Birch, Stewart, Kolasch & Birch, LLP

(57) ABSTRACT

A vacuum cleaner including: a suctioning unit; a main body including a cyclone part for separating dust from suctioned air and a dust container for storing the separated dust, and a body cover for opening and closing the lower side of the body; a filter unit, disposed in the body, for filtering air separated from the dust; an actuating unit capable of moving in the body between the outside of the filter unit and the inner circumference surface of the body; an operating unit disposed outside the body which operates in order to move
(Continued)

the actuating unit; a transmission unit penetrating the body and connecting the actuating unit with the operating unit; and an elastic member disposed outside the body which elastically supports the operating unit.

13 Claims, 24 Drawing Sheets

(30) Foreign Application Priority Data

| | | |
|---|---|---|
| Sep. 14, 2018 | (KR) | 10-2018-0110026 |
| Nov. 26, 2018 | (KR) | 10-2018-0147379 |
| Feb. 22, 2019 | (KR) | 10-2019-0021320 |
| Jun. 27, 2019 | (KR) | 10-2019-0077237 |

(51) Int. Cl.
*A47L 9/32* (2006.01)
*A47L 5/24* (2006.01)
*A47L 9/12* (2006.01)

(58) Field of Classification Search
USPC ..... 15/352
See application file for complete search history.

(56) References Cited

U.S. PATENT DOCUMENTS

| | | | | |
|---|---|---|---|---|
| 2,714,426 | A | 8/1955 | White | |
| 3,797,064 | A | 3/1974 | MacFarland | |
| 5,704,956 | A | 1/1998 | Loveless et al. | |
| 6,625,845 | B2 | 9/2003 | Matsumoto et al. | |
| 7,074,248 | B2 | 7/2006 | Jin et al. | |
| 7,370,387 | B2 | 5/2008 | Walker et al. | |
| 7,594,297 | B2 | 9/2009 | Choi | |
| 8,156,609 | B2 | 4/2012 | Milne et al. | |
| 8,308,831 | B2 | 11/2012 | Coburn | |
| 8,925,145 | B2 | 1/2015 | Wilson | |
| 9,687,128 | B2 | 6/2017 | Fan et al. | |
| 10,143,345 | B2 | 12/2018 | Peters | |
| 10,231,587 | B2 | 3/2019 | Krebs et al. | |
| 10,299,648 | B2 | 5/2019 | Peters et al. | |
| 10,390,670 | B2 | 8/2019 | Robinson et al. | |
| 2001/0025395 | A1 | 10/2001 | Matsumoto et al. | |
| 2008/0264011 | A1 | 10/2008 | Oh et al. | |
| 2014/0215751 | A1 | 8/2014 | Kasper et al. | |
| 2016/0183750 | A1* | 6/2016 | Fan | A47L 13/225 15/347 |
| 2018/0055318 | A1 | 3/2018 | Gottschall et al. | |
| 2018/0125316 | A1 | 5/2018 | Woo et al. | |
| 2018/0132685 | A1 | 5/2018 | Muir et al. | |
| 2018/0132686 | A1* | 5/2018 | Muir | A47L 9/325 |
| 2019/0183301 | A1 | 6/2019 | Hwang et al. | |
| 2020/0069130 | A1 | 3/2020 | Mantes et al. | |

FOREIGN PATENT DOCUMENTS

| | | | | |
|---|---|---|---|---|
| CN | 1911151 | A | 2/2007 | |
| CN | 106993977 | A | 8/2017 | |
| CN | 106993978 | A | 8/2017 | |
| CN | 106993979 | A | 8/2017 | |
| CN | 207384196 | U | 5/2018 | |
| EP | 1136028 | A2 * | 9/2001 | A47L 9/108 |
| EP | 1 987 754 | A2 | 11/2008 | |
| EP | 3 175 759 | A1 | 6/2017 | |
| JP | 54-51258 | A | 4/1979 | |
| JP | 2001-269297 | A | 10/2001 | |
| JP | 2002-51949 | A | 2/2002 | |
| JP | 2002-223993 | A | 8/2002 | |
| JP | 2002-282178 | A | 10/2002 | |
| JP | 2003-190056 | A | 7/2003 | |
| JP | 2003-310507 | A | 11/2003 | |
| JP | 2004-249010 | A | 9/2004 | |
| JP | 2004-298860 | A | 10/2004 | |
| JP | 3699679 | | 9/2005 | |
| JP | 2006-205168 | A | 8/2006 | |
| JP | 2006-320455 | A | 11/2006 | |
| JP | 2006-340972 | A | 12/2006 | |
| JP | 2007-029187 | A | 2/2007 | |
| JP | 2008-080146 | | 4/2008 | |
| JP | 2009-504305 | A | 2/2009 | |
| JP | 4682693 | B2 | 5/2011 | |
| JP | 2011-188910 | A | 9/2011 | |
| JP | 2013-22048 | A | 2/2013 | |
| JP | 2013-022224 | A | 2/2013 | |
| JP | 2017-159022 | A | 9/2017 | |
| JP | 6366750 | B2 | 8/2018 | |
| JP | 2019-523118 | A | 8/2019 | |
| KR | 10-2001-0090527 | A | 10/2001 | |
| KR | 10-2004-0085308 | A | 10/2004 | |
| KR | 10-0606794 | B1 | 8/2006 | |
| KR | 10-2006-0098765 | A | 9/2006 | |
| KR | 10-0634805 | B1 | 9/2006 | |
| KR | 10-0634805 | | 10/2006 | |
| KR | 10-2006-0117001 | A | 11/2006 | |
| KR | 10-0871484 | B1 | 12/2008 | |
| KR | 10-0880492 | | 1/2009 | |
| KR | 10-2011-0071920 | A | 6/2011 | |
| KR | 10-1649250 | B1 | 8/2016 | |
| KR | 10-2018-0023790 | A | 3/2018 | |
| KR | 10-2018-0053614 | A | 5/2018 | |
| KR | 10-2018-0100201 | | 9/2018 | |
| TW | 201735847 | A | 10/2017 | |
| WO | WO 2018/038473 | A1 | 3/2018 | |
| WO | WO 2019/164258 | A1 | 8/2019 | |

OTHER PUBLICATIONS

Korean Office Action issued in KR 10-2020-0113003, dated Apr. 28, 2021 (3 pages).
Korean Notice of Allowance issued in KR 10-2020-0113003, dated Jun. 3, 2021 (2 pages).
PCT Search Report of PCT/KR2019/011944 dated Dec. 20, 2019 (4 pages).
Notice of Allowance in Korean Application No. 10-2020-0038445, dated Nov. 29, 2021, (2 pages).
Notice of Allowance in Korean Application No. 10-2020-0040200, dated Nov. 29, 2021, (2 pages).
Office Action in Chinese Application No. 201980059941.3, dated Nov. 3, 2021, (9 pages).
Office Action in Chinese Application No. 201980059724.4, dated Sep. 6, 2021, (8 pages).
Office Action in Chinese Application No. 201980059972.9, dated Sep. 1, 2021, (9 pages).
Office Action in Chinese Application No. 201980059929.2, dated Aug. 25, 2021, (7 pages).
Attached is the Australian Office Action for Australian Application No. 2019338911, dated Apr. 29, 2022.
Also attached is the Australian Office Action for Australian Application No. 2019338912, dated Apr. 29, 2022.
Also attached is the Extended European Search Report for European Application No. 19859360.0, dated May 9, 2022.
Also attached is the Japanese Office Action for Japanese Application No. 2021-513938, dated Apr. 19, 2022.
Also attached is the U.S. Office Action for U.S. Appl. No. 17/275,060, dated Apr. 13, 2022.
Extended European Search Report for European Application No. 19859471.5, dated Jun. 28, 2022.

* cited by examiner

VACUUM CLEANER

CROSS-REFERENCES TO RELATED APPLICATIONS

This application is a National Stage filing under 35 U.S.C. 371 of PCT International Application No. PCT/KR2019/011944, filed on Sep. 16, 2019, which claims the benefit of earlier filing date and right of priority under 35 U.S.C. 119(a) to Korean Application No. 10-2018-0110019, filed on Sep. 14, 2018, Korean Application No. 10-2018-0110021, filed on Sep. 14, 2018, Korean Application No. 10-2018-0110026, filed on Sep. 14, 2018, Korean Application No. 10-2018-0147379, filed on Nov. 26, 2018, Korean Application No. 10-2019-0021320, filed on Feb. 22, 2019, and Korean Application No. 10-2019-0077237, filed on Jun. 27, 2019, the contents of all of which are hereby incorporated by reference herein in their entirety.

TECHNICAL FIELD

The present disclosure relates to a cleaner.

BACKGROUND

Cleaners are devices which absorb or clean dust or particles in a cleaning target zone to perform cleaning.

The cleaners may be categorized into manual vacuum cleaners which perform cleaning while being moved on the basis of direct manipulation by a user and automatic vacuum cleaners which perform cleaning while moving autonomously.

Also, the manual vacuum cleaners may be categorized into canister-type cleaners, upright-type cleaners, handy-type cleaners, and stick-type cleaners on the basis of types of cleaners.

The prior art reference Japanese Patent Registration No. 3699679 discloses technology for compressing internal dust of a dust collection case.

The dust collection case includes a dust separation chamber which separates dust from air with a centrifugal force, a dust accommodating chamber which accommodates inflow dust, an intake cylinder which is disposed at a center portion of the dust separation chamber, and a filter which is disposed outside the intake cylinder.

Air of the dust separation chamber passes through the filter, and then, moves into the intake cylinder.

An outer canister is provided outside the intake cylinder, a compression plate is provided under the outer canister, and a brush is provided on an inner circumference surface of the outer canister. A plurality of opening portions are provided in the outer canister so as not to hinder flow of air from the dust separation chamber to the intake cylinder.

In order to manipulate the outer canister, a manipulation lever is provided outside the outer canister in a diameter direction of the outer canister. The manipulation lever is disposed outside the dust separation chamber.

Therefore, when a user manipulates the manipulation lever to lower the outer canister and the compression plate, the brush on an inner surface of the outer canister cleans the filter outside the intake cylinder, and the compression plate compresses dust stored in the dust accommodating chamber.

However, in the prior art reference, the outer canister is configured to surround the whole of the intake cylinder in a state where the manipulation lever is not manipulated, and thus, the plurality of opening portions are provided in the outer canister in order for air to pass through the outer canister.

However, although the plurality of opening portions are provided in the outer canister, a portion where an opening portion is not provided act as an air flow resistor, causing a reduction in air flow performance.

Moreover, since the outer canister is disposed outside the intake cylinder, dust of the dust separation chamber contacts the outer canister in a state where the manipulation lever is not manipulated, and due to this, the outer canister is polluted, whereby it is required to additionally clean the outer canister.

Moreover, in the prior art reference, since the manipulation lever is disposed outside the dust separation chamber, a slot should be vertically provided in the dust separation chamber in order for the manipulation lever to vertically move.

The manipulation lever does not cover the whole of the slot, and due to this, the internal air and dust of the dust separation chamber is leaked to the outside through the slot.

Moreover, in the prior art reference, a spring supports the manipulation lever, but in this case, the spring is exposed at the outside, causing a reduction in a sense of beauty. Also, a length of the spring is determined based on a movement length of the manipulation lever, but since the spring is not stably supported in a lengthwise direction of the spring, the manipulation lever is not eccentric, causing a problem where vertical movement is difficult.

Moreover, in the prior art reference, the dust collection case may be detached from a cleaner body, and then, the manipulation lever may be manipulated, causing the inconvenience of a user.

SUMMARY

Technical Problem

The present embodiment provides a cleaner which compresses dust of a dust container by manipulating a compression mechanism.

The present embodiment provides a cleaner which enables a user to easily recognize a manipulation part and prevents the manipulation part from contacting a floor in a state where the cleaner is on the floor.

The present embodiment provides a cleaner which enables the stable movement of a transfer part for transferring a manipulation force of a manipulation part to a movable part.

The present embodiment provides a cleaner which prevents a manipulation part from being undesirably manipulated by an elastic force of an elastic member applied to the manipulation part in a cleaning process.

The present embodiment provides a cleaner which prevents an elastic member elastically supporting a manipulation part from being exposed at the outside.

Technical Solution

A cleaner includes: a suction part; a main body including a body, including a cyclone part configured to separate dust from air suctioned through the suction part and a dust container configured to store the dust separated by the cyclone part, and a body cover configured to open or close a lower portion of the body; a filter part disposed in the body and configured to filter air in a process where air separated from dust in the cyclone part passes through the filter part;

a movable part configured to move along a space between an outer portion of the filter part and an inner circumference surface of the body in the body; a manipulation part disposed outside the main body and manipulated for moving the movable part; a transfer part passing through the main body and connecting the movable part to the manipulation part; and an elastic member disposed outside the main body to elastically support the manipulation part.

An inner portion of the body may be an internal space of the body, and an outer portion of the body may be the outside of the internal space of the body.

The elastic member may support the manipulation part at a position which is apart from the transfer part in a horizontal direction.

The elastic spring may be, for example, a coil spring. At a manipulation standby position of the manipulation part, a length of the elastic member may be longer than a length of the transfer part.

The cleaner may further include a supporting bar coupled to the manipulation part to pass through the manipulation part. The supporting bar may guide the vertical movement of the manipulation part.

The supporting bar may be disposed in an internal region of the coil spring.

The cleaner may further include an extension body extending downward from the manipulation part and surrounding the elastic member.

The cleaner may further include a cover body supporting a lower portion of the elastic member and extending from the body to surround the lower portion of the elastic member.

At a manipulation standby position of the manipulation part, a portion of the extension body may be disposed to overlap the cover body in a horizontal direction, thereby preventing the elastic member from being exposed at the outside.

For example, a portion of the extension body may be disposed in an internal space of the cover body.

The cleaner may further include a stopper extending from the body and contacting the manipulation part at a standby manipulation position of the manipulation part. The supporting bar may pass through the manipulation part and may be coupled to the stopper.

The cleaner may further include a handle part coupled to an outer portion of the body, the handle part including a handle body. The transfer part may be covered by the handle body, and the elastic member may be disposed outside the handle body.

Advantageous Effects

According to the embodiments, since the movable part of the compression mechanism is disposed in the body and the manipulation part is disposed outside the main body, the user may manipulate the manipulation part, and thus, dust in the main body may be compressed.

Moreover, since the manipulation part is disposed outside the main body and the handle part guides the vertical movement of the manipulation part while covering a portion of the manipulation part, the manipulation part may stably and vertically move without being shaken in a horizontal direction.

Moreover, the elastic member may support the manipulation part at the standby position of the manipulation part, thereby preventing a phenomenon where the manipulation part is lowered due to a weight of the compression mechanism.

Moreover, since the cover body which covers the elastic member is provided outside the main body and the extension body which accommodates the upper portion of the elastic member is provided under the manipulation part, the elastic member may be prevented from being exposed at the outside, and particles may be prevented from moving to the elastic member.

Moreover, since the elastic member is accommodated into the cover body, the upper portion is accommodated into the extension body, and the supporting bar is disposed inside the elastic member, the horizontal-direction movement of the elastic member may be limited, and thus, the elastic member may stably operate in a vertical direction, whereby the vertical movement of the manipulation part may be smoothly performed.

DETAILED DESCRIPTION

Figure 1:
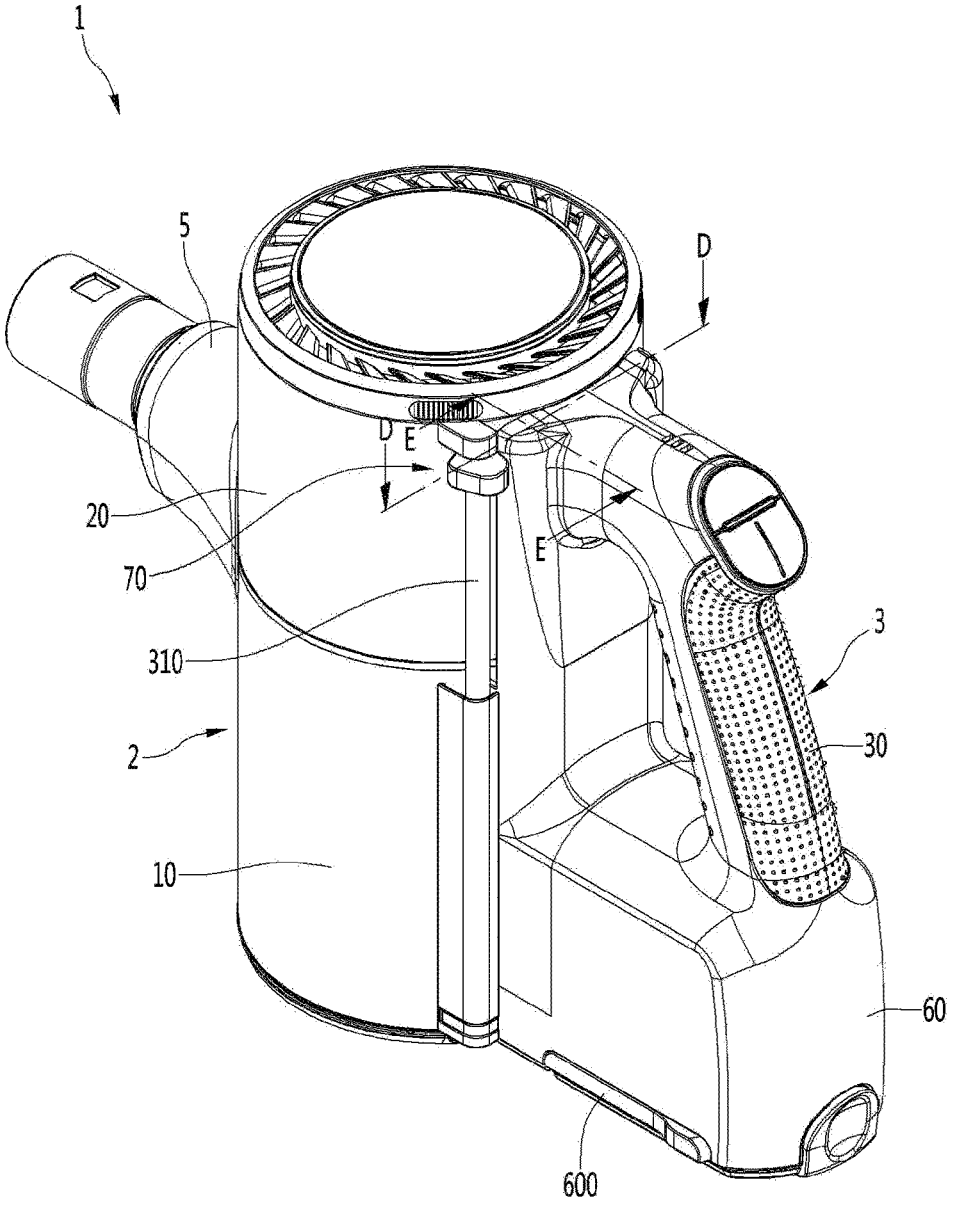
FIG. 1 is a perspective view of a cleaner according to an embodiment.

Hereinafter, exemplary embodiments of the present disclosure will be described in detail with reference to the accompanying drawings. In adding reference numerals for elements in each figure, it should be noted that like reference numerals already used to denote like elements in other figures are used for elements wherever possible. Moreover, detailed descriptions related to well-known functions or configurations will be ruled out in order not to unnecessarily obscure subject matters of the present disclosure.

In describing the elements of the present disclosure, terms such as first, second, A, B, (a), (b), etc., may be used. Such terms are used for merely discriminating the corresponding elements from other elements and the corresponding elements are not limited in their essence, sequence, or precedence by the terms. It will be understood that when an element or layer is referred to as being "on" or "connected to" another element or layer, it may be directly on or directly connected to the other element or layer, or intervening elements or layers may be present.

Figure 2:
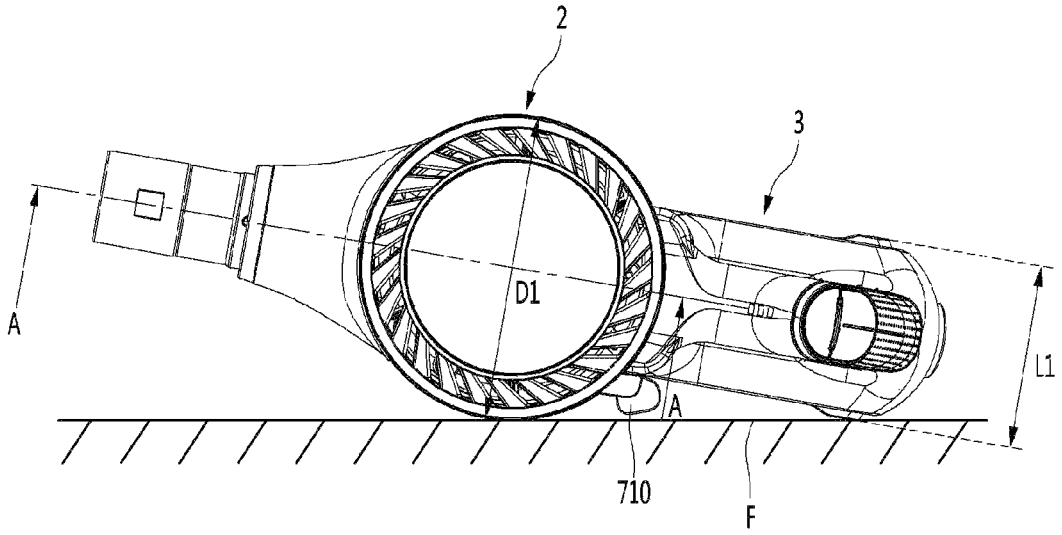
FIG. 2 is a diagram illustrating a state where a cleaner according to an embodiment is located on a floor surface with being laid.
Figure 3:
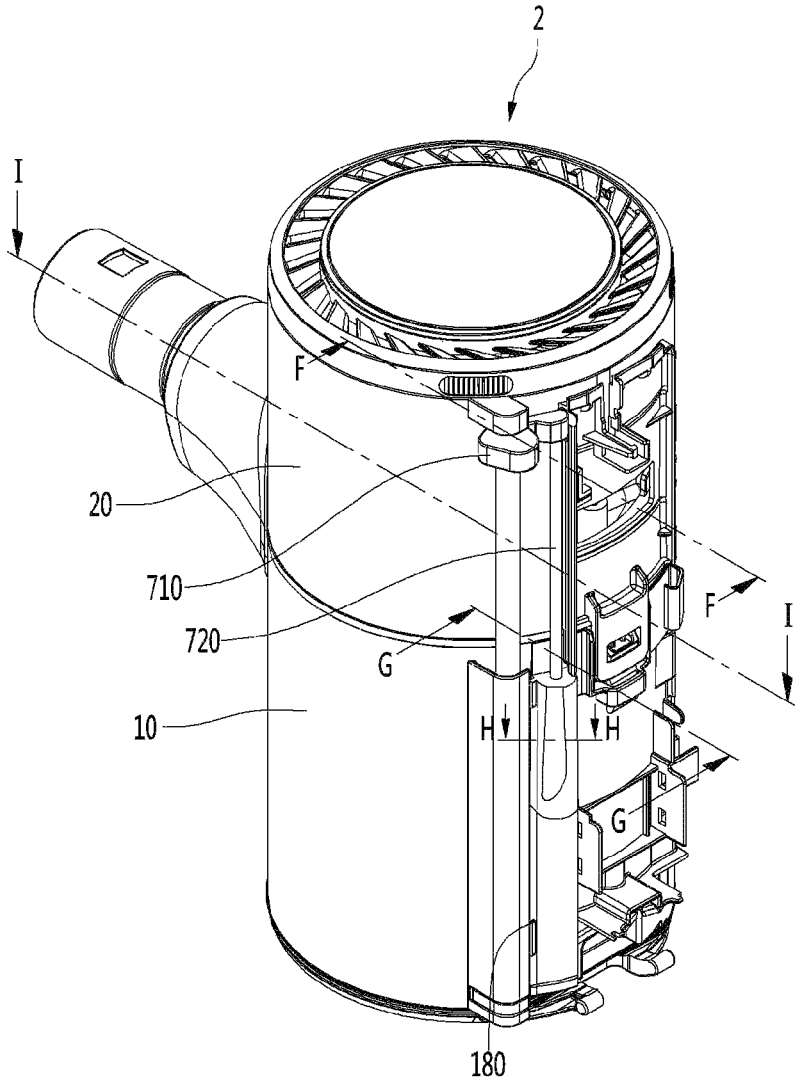
FIG. 3 is a perspective view illustrating a state where a handle part is detached from a cleaner according to an embodiment.
Figure 4:
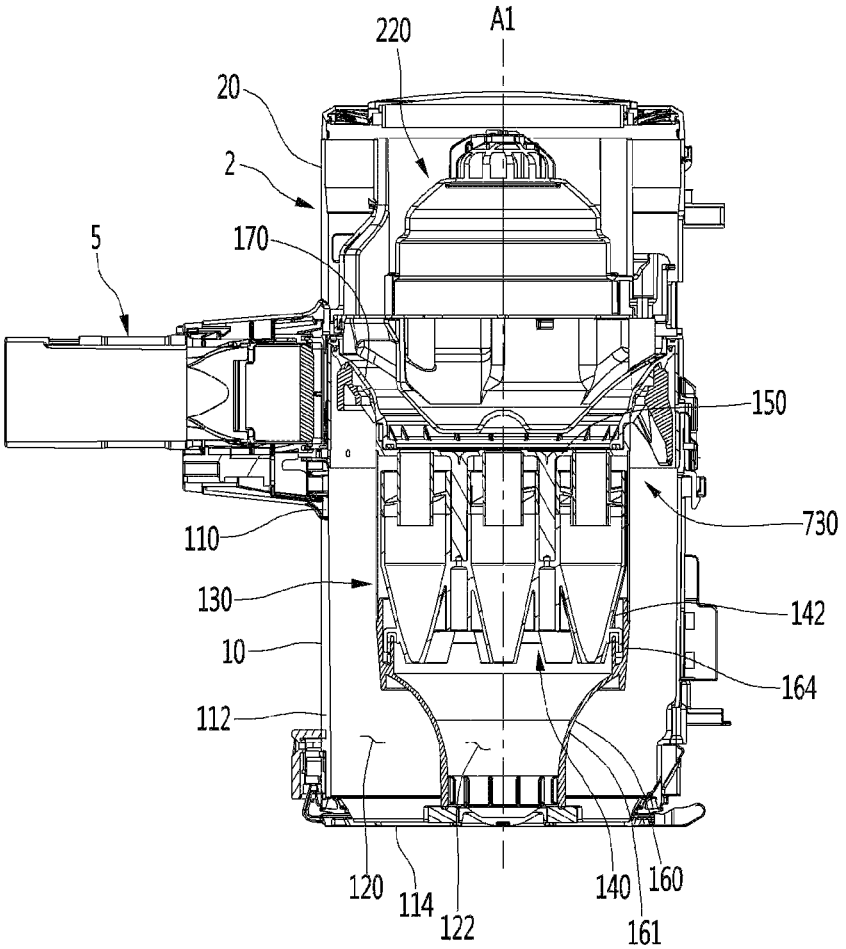
FIG. 4 is a cross-sectional view taken along line A-A of FIG. 2.

FIG. 1 is a perspective view of a cleaner according to an embodiment, FIG. 2 is a diagram illustrating a state where a cleaner according to an embodiment is located on a floor surface with being laid, FIG. 3 is a perspective view illustrating a state where a handle part is detached from a cleaner according to an embodiment, and FIG. 4 is a cross-sectional view taken along line A-A of FIG. 2.

Figure 5:
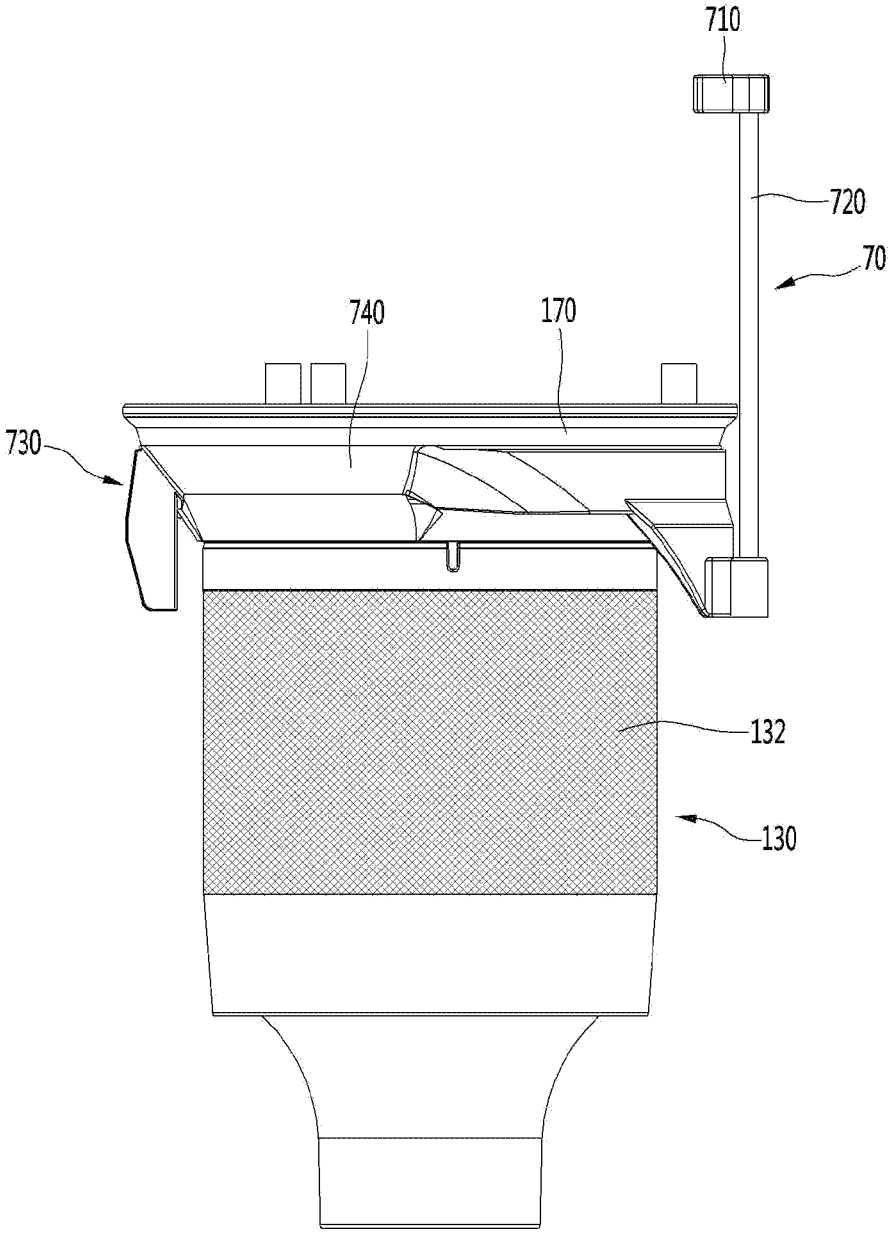
FIG. 5 is a diagram illustrating the arrangement of a movable part, a filter part, and an air guide of a compression mechanism.

FIG. 5 is a diagram illustrating the arrangement of a movable part, a filter part, and an air guide of a compression mechanism.

Referring to FIGS. 1 to 5, a cleaner 1 according to an embodiment may include a main body 2. The main body 2 may include a suction part 5 which sucks dust-containing air. The suction part 5 may guide dust containing air to the main body 2.

The cleaner 1 may further include a handle part 3 coupled to the main body 2. The handle part 3 may be disposed at a position opposite to the suction part 5 in the main body 2 for example. However, positions of the suction part 5 and the handle part 3 are not limited thereto.

The main body 2 may separate dust suctioned through the suction part 5 and may store the separated dust.

For example, the main body 2 may include a dust separation part. The dust separation part may include a first cyclone part 110 for separating dust through cyclone flow. The first cyclone part 110 may communicate with the suction part 5.

Air and dust suctioned through the suction part 5 may spirally move along an inner circumference surface of the first cyclone part 110.

The dust separation part may further include a second cyclone part 140 which secondarily separates dust from air discharged from the first cyclone part 110.

The second cyclone part 140 may include a plurality of cyclone bodies 142 disposed in parallel. Air may divisionally pass through the plurality of cyclone bodies 142.

As another example, the dust separation part may include a single cyclone part.

The main body 2 may be provided in a cylindrical shape for example, and an external appearance thereof may be formed by a plurality of bodies.

For example, the main body 2 may include a first body 10 which is substantially cylindrical in shape and a second main body 20 which is coupled to an upper portion of the first body 10 and is substantially cylindrical in shape.

An upper portion of the first body 10 may define the first cyclone part 110, and a lower portion of the first body 10 may define a dust container 112 which stores dust separated from the first cyclone part 110.

The lower portion of the first body 10 (i.e., a lower portion of the dust container 112) may be opened or closed by a body cover 114 which rotates based on a hinge.

The main body 2 may further include a filter part 130 which is disposed to surround the second cyclone part 140.

The filter part 130 may be provided in a cylindrical shape for example and may guide air, separated from dust in the first cyclone part 110, to the second cyclone part 140. The filter part 130 may filter out dust in a process where air passes through the filter part 130.

To this end, the filter part 130 may include a mesh portion including a plurality of holes. The mesh portion 132 is not limited, but may be formed of a metal material.

The mesh portion 132 may filter air, and due to this, dust may be collected in the mesh portion 132, whereby it is required to clean the mesh portion 132.

In an embodiment, the cleaner 1 may further include a compression mechanism 70 for compressing dust stored in the dust container (i.e., a first dust storage part).

Since capacity of the dust container 112 is limited, the amount of dust stored in the dust container 112 may increase during repeated cleaning, and thus a usage time of and the number of times the cleaner is used may be limited.

If the amount of dust stored in the dust container 112 increases, the user may cause the body cover 114 to open the dust container 112 to remove dust of the dust container 112.

In this embodiment, when dust stored in the dust container 112 is compressed using the compression mechanism 70, density of the dust stored in the dust container 112 increases, and thus a volume thereof decreases.

Therefore, according to the present embodiment, the number of times for emptying the dust container 112 is reduced, and accordingly, an available time before emptying the dust container advantageously increases.

The compression mechanism 70 may also clean the mesh portion 132 during a movement process.

The compression mechanism 70 may include a movable part 730 which is movable in the main body 2, a manipulation part 710 which is manipulated by a user so as to move the movable part 730, and a transfer part 720 which transfers a manipulation force of the manipulation part 710 to the movable part 730.

The manipulation part 710 may be disposed outside the main body 2. For example, the manipulation part 710 may be disposed outside the first body 10 and the second main body 20. The manipulation part 710 may be disposed to be higher than the first body 10. Also, the manipulation part 710 may be disposed to be higher than the movable part 730.

The handle part 3 may include a handle body 30 which is gripped by a user and a battery housing 60 which is disposed under the handle body 30 to accommodate a battery 600.

The handle body 30 may cover a portion of the manipulation part 710 and may guide movement of the manipulation part 710.

In a state where the user grips the handle body 30 with a right hand, the manipulation part 710 may be disposed to the left of the handle body 30.

Therefore, the user may easily manipulate the manipulation part 710 with a left hand which does not grip the handle body 30.

The manipulation part 710 may move in a direction parallel to a cyclone flow axis A1 of the first cyclone part 110. For example, the cyclone flow axis A1 of the first cyclone part 110 may extend in a vertical direction in a state where the dust container 112 is located on a floor.

Therefore, the manipulation part 710 may move in a vertical direction in a state where the dust container 112 is located on the floor.

A slot 310 may be provided in the handle body 30, for movement of the manipulation part 710. The slot 310 may extend in a direction parallel to an extension direction of the cyclone flow axis A1 of the first cyclone part 110.

In the present embodiment, the extension direction of the cyclone flow axis A1 may be a vertical direction in the drawing for example, and thus, it may be understood that "vertical direction" described below denotes the extension direction of the cyclone flow axis A1.

Referring to FIG. 2, a diameter D1 of the main body 2 may be set to be longer than a horizontal length L1 of the handle part 3. Also, the handle part 3 may be coupled to the main body 2 so that a horizontal center of the handle part 3 matches a center of the main body 2.

The manipulation part 710 may be disposed at, for example, a boundary portion where the main body 2 contacts the handle part 3.

Based on a difference between a diameter of the main body 2 and a horizontal length of the handle part 3, when the cleaner 1 is laid in order for the main body 2 and the handle part 3 to contact a floor F, a space may be provided between an outer circumference surface of the main body 2, an outer circumference surface of the handle part 3, and the floor F, and the manipulation part 710 may be disposed in the space.

In this state, the manipulation part 710 may be apart from the floor F. Therefore, the manipulation part 710 may be prevented from being damaged or undesirably manipulated due to a collision between the manipulation part 710 and the floor F in the middle of laying the cleaner 1 on the floor F.

The transfer part 720 may be provided in a cylindrical bar shape for example, and the manipulation part 710 may be coupled to an upper end portion of the transfer part 720. That is, the transfer part 720 may include a horizontal cross-sectional surface provided in a circular shape.

Moreover, the transfer part 720 may extend in a direction parallel to the extension direction of the cyclone flow axis A1 of the first cyclone part 110.

Since the movable part 730 is disposed in the main body 2 and the manipulation part 710 is disposed outside the main body 2, a portion of the transfer part 720 may be disposed outside the main body 2 in order for the movable part 730 to be connected to the manipulation part 710, and another portion of the transfer part 720 may be disposed in the main body 2. That is, the transfer part 720 may pass through the main body 2. Also, a portion, disposed outside the main body 2, of the transfer part 720 may be covered by the handle part 3.

The main body 2 may further include a guide body 180 for guiding the transfer part 720. The guide body 180, for example, may be disposed outside the first body 10 to protrude.

The guide body 180 may extend in a direction parallel to the extension direction of the cyclone flow axis A1 of the first cyclone part 110.

The guide body 180 may communicate with an internal space of the first body 10, and the transfer part 720 may move in the guide body 180.

A detailed structure of the guide body 180 will be described below in detail with reference to the drawings.

The main body 2 may further include a suction motor 220 for generating a suction force. The suction force generated by the suction motor 220 may be applied to the suction part 5.

The suction motor 220 may be disposed in the second body 20.

The suction motor 220 may be disposed above the dust container 112 and the battery 600 with respect to the extension direction of the cyclone flow axis A1 of the first cyclone part 110. The manipulation part 710 may be disposed at the same height as a portion of the suction motor 220, or may be disposed to be higher than the suction motor 220.

The main body 2 may further include an air guide 170 for guiding air, discharged from the second cyclone part 140, to the suction motor 220.

The second cyclone part 140 may be coupled to a lower portion of the air guide 170. The filter part 130 may surround the second cyclone part 140 with being coupled to the second cyclone part 140.

Therefore, the filter part 130 may be disposed under the air guide 170. The movable part 730 may be disposed at a position surrounding the air guide 170 in a state where the manipulation part 710 is not manipulated.

The movable part 730 may include a cleaning part 740 for cleaning the filter part 130.

In the present embodiment, a position of the compression mechanism 70 in a state where the manipulation part 710 is not manipulated may be referred to as a standby position, and a position of the manipulation part 710 may be referred to as a manipulation standby position.

At the standby position of the compression mechanism 70, the whole of the cleaning part 7 40 may be disposed not to overlap the filter part 130 in a direction in which air passes through the filter part 130.

For example, the whole of the cleaning part 740 may be disposed to be higher than the filter part 130 at the standby position. Accordingly, at the standby position, the cleaning part 740 may be prevented from acting as a flow resistor in a process where air passes through the filter part 130.

A dust guide 160 may be provided under the second cyclone part 140. A lower portion of the second cyclone part 140 may be coupled to an upper portion of the dust guide 160. Also, a lower portion of the filter part 130 may be seated on the dust guide 160.

The lower portion of the dust guide 160 may be seated on the body cover 114. The dust guide 160 may be apart from an inner circumference surface of the first body 10 and may divide an internal space of the first body 10 into a first dust storage part 120 which stores dust separated from the first cyclone part 110 and a second dust storage part 122 which stores dust separated from the second cyclone part 140.

The inner circumference surface of the first body 10 and an outer circumference surface of the dust guide 160 may define the first dust storage part 120, and an inner circumference surface of the dust guide 160 may define the second dust storage part 122.

Compression Mechanism

Hereinafter, the compression mechanism 70 will be described in detail.

Figure 6:
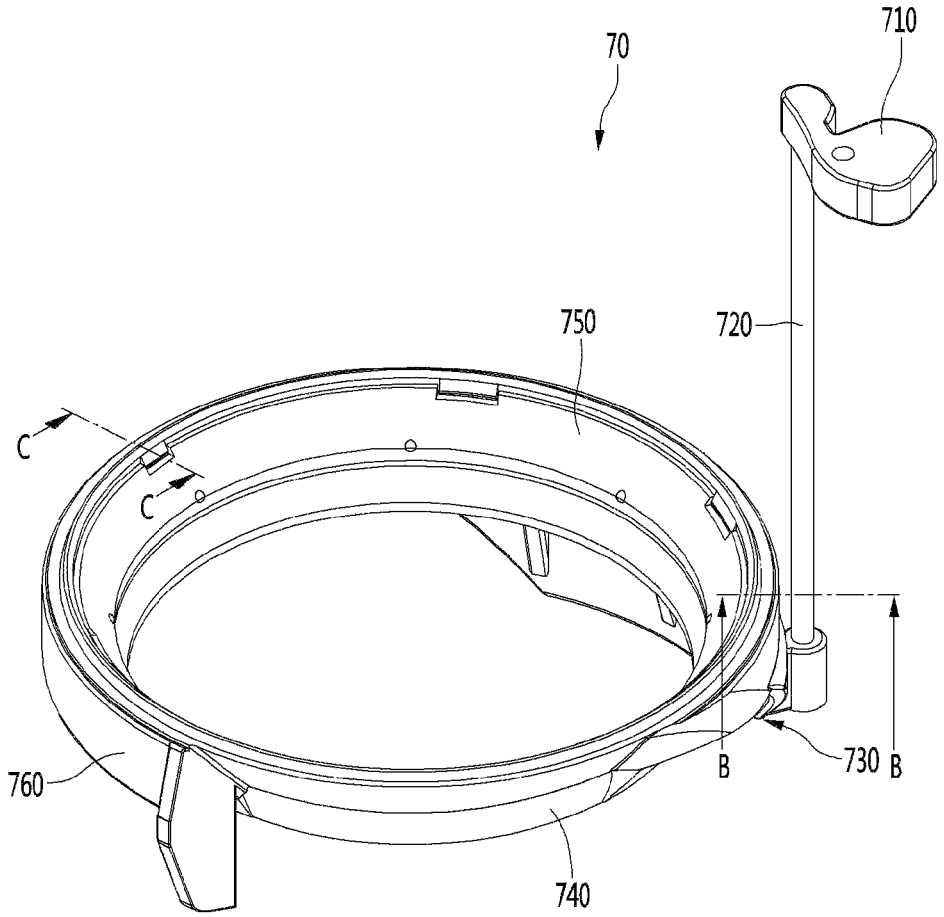
FIGS. 6 and 7 are perspective views of a compression mechanism according to an embodiment.
Figure 7:
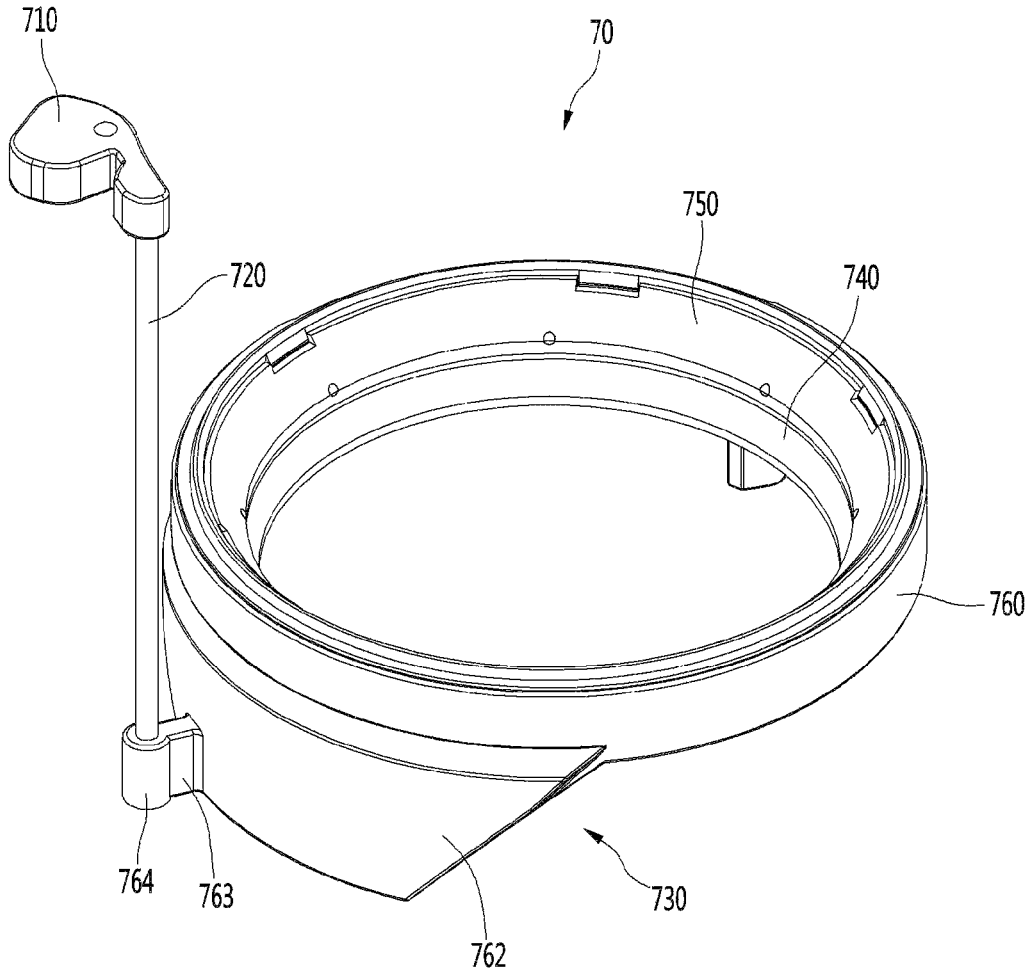
Figure 8:
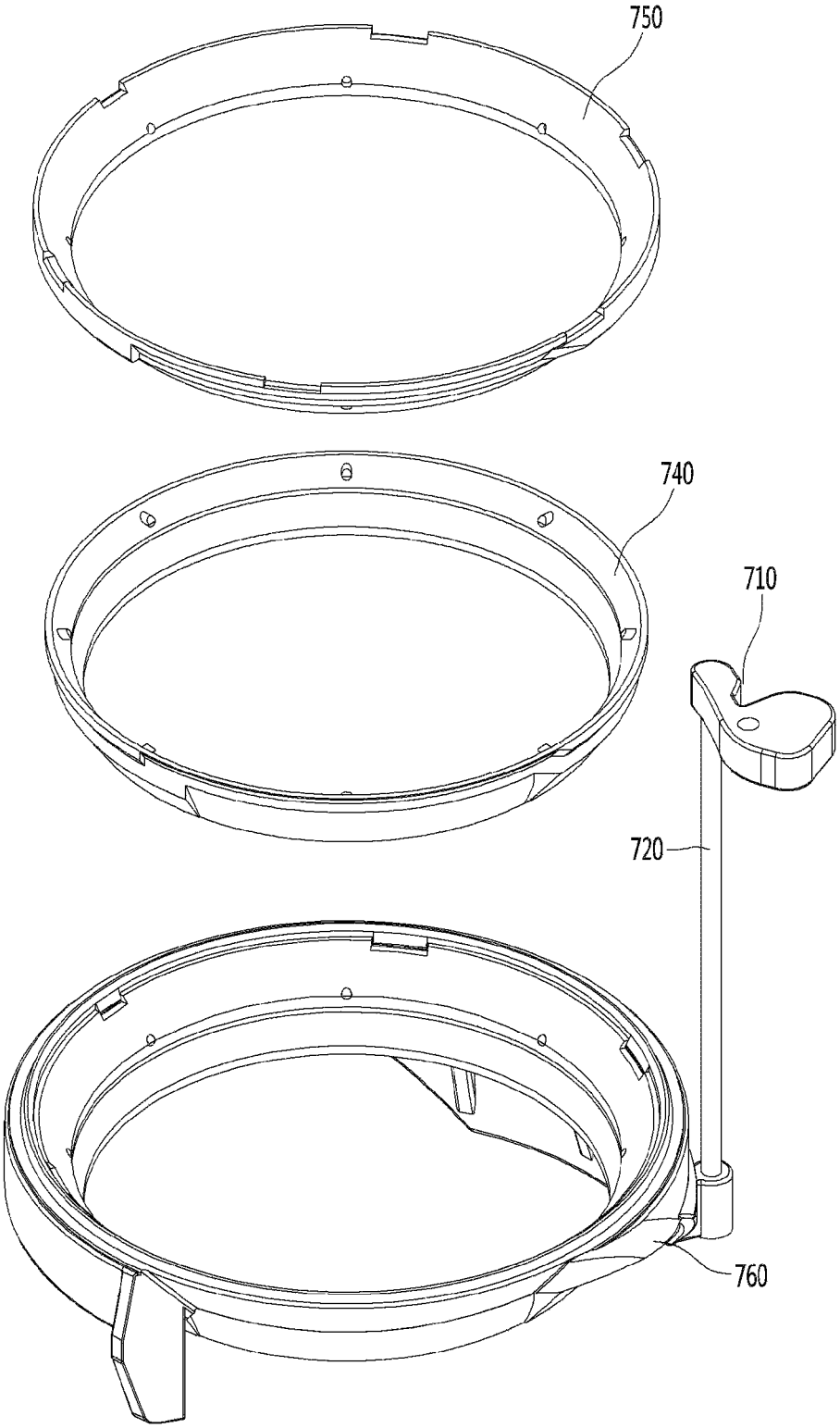
FIG. 8 is an exploded perspective view of a compression mechanism according to an embodiment.

FIGS. 6 and 7 are perspective views of a compression mechanism according to an embodiment, and FIG. 8 is an exploded perspective view of a compression mechanism according to an embodiment.

Figure 9:
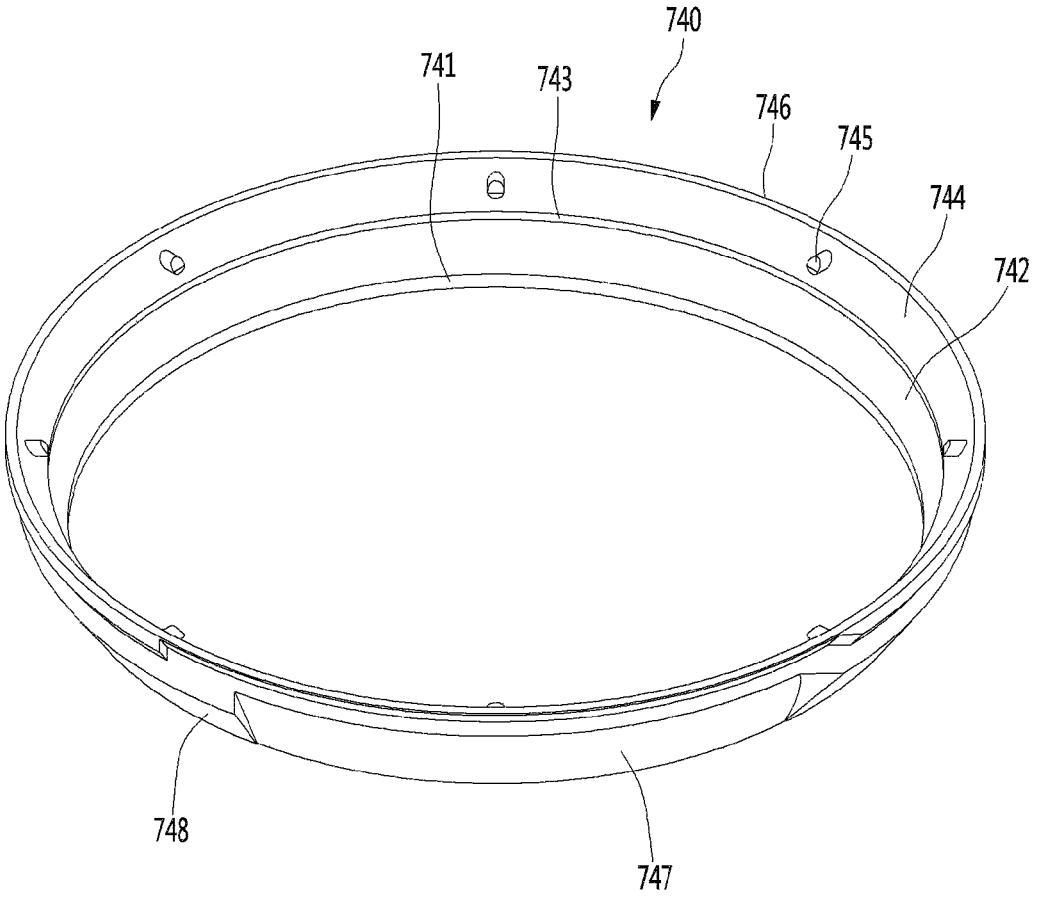
FIG. 9 is a perspective view of a cleaning part according to an embodiment.
Figure 10:
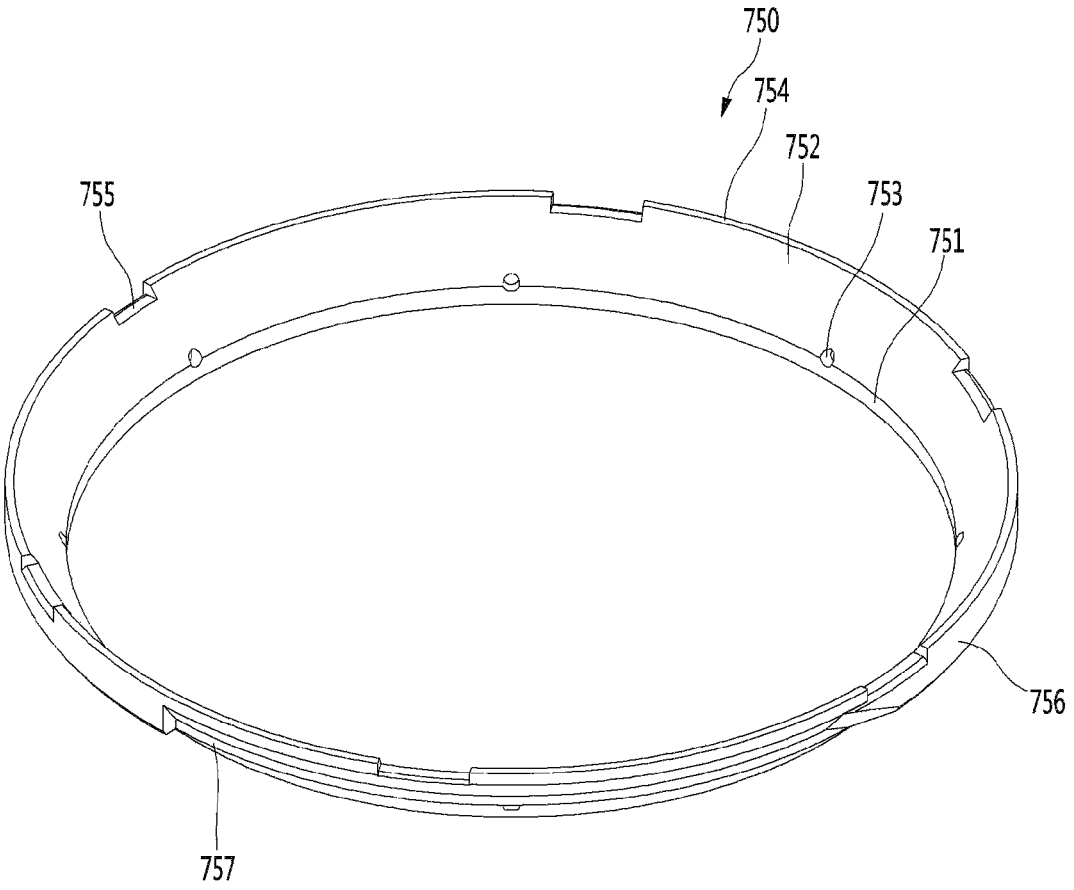
FIG. 10 is a perspective view of a core part according to an embodiment.
Figure 11:
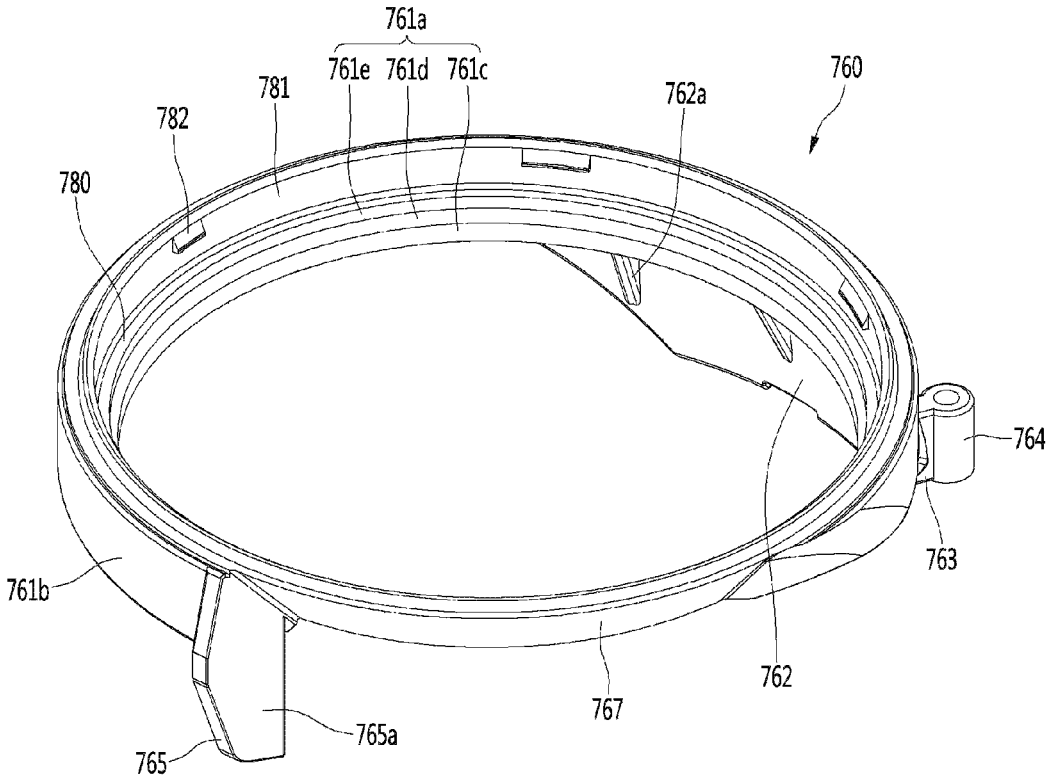
FIG. 11 is a perspective view when a frame according to an embodiment is seen from above.
Figure 12:
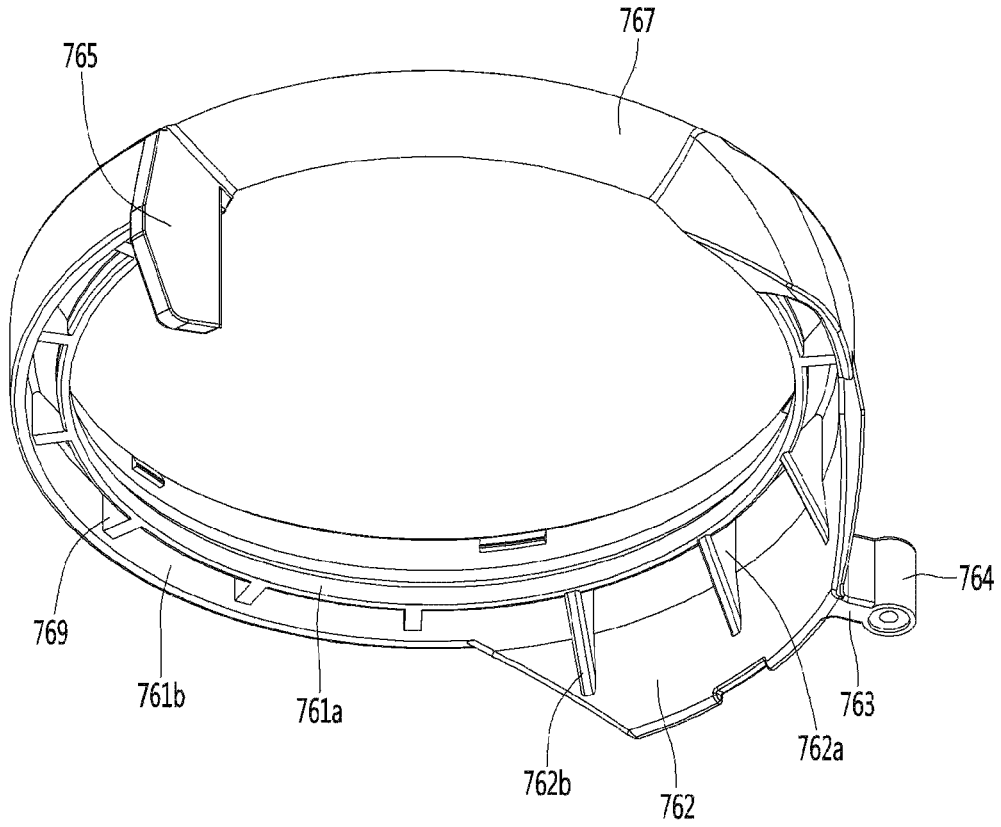
FIG. 12 is a perspective view when a frame according to an embodiment is seen from below.

FIG. 9 is a perspective view of a cleaning part according to an embodiment, FIG. 10 is a perspective view of a core part according to an embodiment, FIG. 11 is a perspective view when a frame according to an embodiment is seen from above, FIG. 12 is a perspective view when a frame according to an embodiment is seen from below.

Figure 13:
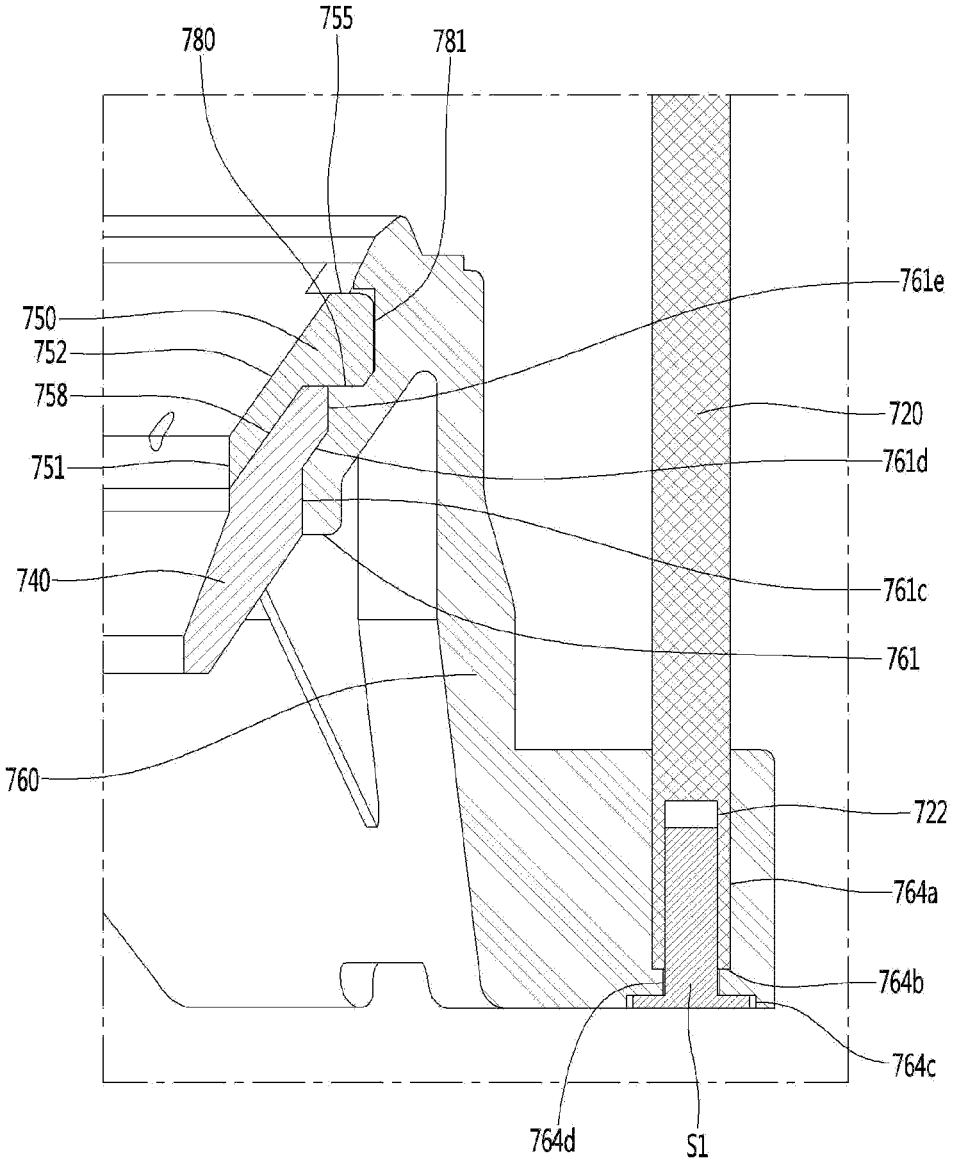
FIG. 13 is a cross-sectional view taken along line B-B of FIG. 6.
Figure 14:
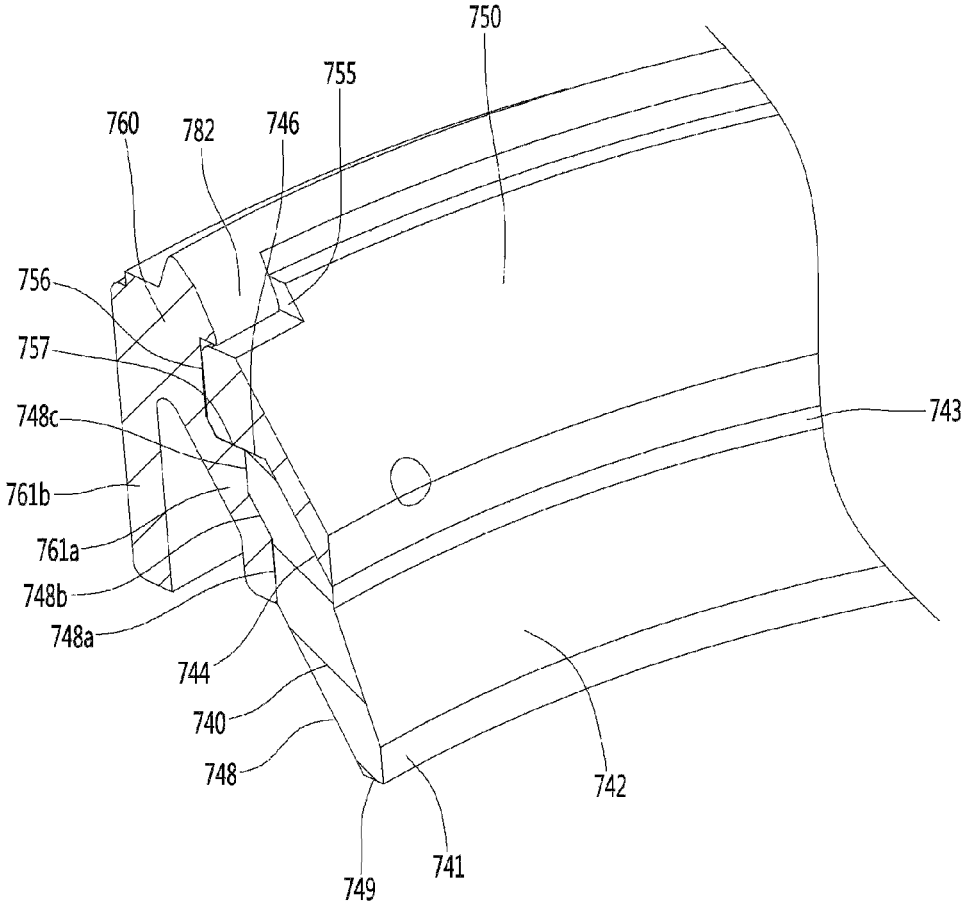
FIG. 14 is a cross-sectional view taken along line C-C of FIG. 6.

FIG. 13 is a cross-sectional view taken along line B-B of FIG. 6, and FIG. 14 is a cross-sectional view taken along line C-C of FIG. 6.

Referring to FIGS. 6 to 14, the movable part 730 may include a cleaning part 740 for cleaning the filter part 130, a frame 760 for supporting an outer perimeter of the cleaning part 740, and a core part 750 for supporting an inner perimeter of the cleaning part 740.

Cleaning Part

The cleaning part 740 may be formed of an elasticity-deformable material. For example, the cleaning part 740 may be formed of a rubber material. The cleaning part 740 may be provided in a ring shape in order for the cleaning part 740 to clean a whole perimeter of the filter part 130. As another example, the cleaning part 740 may be formed of silicon or a fiber material.

Moreover, the cleaning part 740 may stand by at a position deviating from the filter part 130 at the standby position, and in a cleaning process, the cleaning part 740 may move while cleaning an outer surface of the filter part 130.

The cleaning part 740 may include an inner circumference surface, an outer circumference surface, a lower surface 749, and an upper surface 746.

An inner circumference surface of the cleaning part 740 may include a cleaning surface 741 which contacts the outer surface of the filter part 130 in a cleaning process. The cleaning surface 741 may be a surface facing the filter part 130 and may be a vertical surface.

Therefore, when the cleaning part 740 is lowered in a state where the whole of the cleaning surface 741 contacts a circumference perimeter of the filter part 130, the cleaning surface 741 may remove dust adhered to the outer surface of the filter part 130.

The lower surface 749 may be a horizontal surface, and the cleaning surface 741 may extend upward from an inner end portion of the lower surface 749. Accordingly, the lower surface 749 may be vertical to the cleaning surface 741.

As described above, when the cleaning surface 741 is a vertical surface and the lower surface 749 is provided as a horizontal surface vertical to the cleaning surface 741, a phenomenon where a boundary portion between the cleaning surface 741 and the lower surface 749 is inward rolled by friction with the filter part 130 may be prevented in a process where the cleaning part 740 is lowered and then raised.

When the cleaning surface 741 and the lower surface 749 are inward rolled, a contact area between the cleaning surface 741 and the filter part 130 may be reduced, and thus, the cleaning performance of the filter part 130 may be reduced by the cleaning surface 741. However, according to the present embodiment, such a phenomenon may be prevented.

A diameter of the cleaning surface 741 may be set to be less than that of the filter part 130. In the present embodiment, since the cleaning part 740 is formed of an elasticity-deformable material, the cleaning part 740 may be deformed to the outside of the filter part 130 in a radius direction of the filter part 130 in a process where the cleaning part 740 is lowered and thus the cleaning surface 741 contacts the filter part 130, and in an elasticity-deformed state, the cleaning surface 741 may contact the filter part 130.

That is, the cleaning surface 741 may compress the filter part 130 with contacting the filter part 130. Since the cleaning surface 741 compresses the filter part 130 with contacting the filter part 130, dust adhered to the filter part 130 may be effectively removed from the filter part 130.

Moreover, since the cleaning part 740 is formed of an elasticity-deformable material and the whole perimeter of the cleaning surface 741 compresses the filter part 130, even when a center of the cleaning part 740 is inclined with respect to the cyclone flow axis A1 in a process of lowering the cleaning part 740, a state where the cleaning surface 741 of the cleaning part 740 compresses the filter part 130 may be maintained, and thus, the filter part 130 may be cleaned.

A vertical length of the cleaning surface 741 may be set to be longer than a radius-direction length (a horizontal length in the drawing) of the lower surface 749 so that the cleaning performance of the filter part 130 is enhanced and elastic deformation is well performed in the cleaning surface 741 of the cleaning part 740.

The inner circumference surface of the cleaning part 740 may further include a first inner inclined surface 742 which slopingly extends upward from an upper end of the cleaning surface 741 to the outside in a radius direction thereof.

Since the first inner inclined surface 742 is upward inclined to the outside, an inner diameter of the first inner inclined surface 742 in the cleaning part 740 may increase in a direction closer to an upper portion. Also, the first inner inclined surface 742 may be apart from an outer circumference surface of the filter part 130.

The outer circumference surface of the cleaning part 740 may further include a first outer inclined surface 748 which extends to be upward inclined from an outer end portion of the lower surface 749 to the outside in a radius direction thereof.

In this case, an inclined angle of the first outer inclined surface 748 may be greater than an inclined angle of the first inner inclined surface 742 with respect to a vertical line.

Therefore, as seen from a vertical cross-sectional surface, a thickness between the first inner inclined surface 742 and the first outer inclined surface 748 in the cleaning part 740 may be reduced in a direction closer to a lower portion.

This may be for enabling the elasticity deformation of the cleaning part 740 to be well performed in a process of attaching the cleaning surface 741 on the filter part 730 in the cleaning part 740.

The inner circumference surface of the cleaning part 740 may further include an inner vertical surface 743 which vertically extends from the first inner inclined surface 742.

The inner vertical surface 743 may determine a position of a lower end portion of the core part 750 in a process of coupling the core part 750 to the cleaning part 740 through double injection.

The outer circumference surface of the cleaning part 740 may further include a first outer vertical surface **748*a* which vertically extends upward from an upper end portion of the first outer inclined surface 748**.

A length of the first outer vertical surface **748*a* may be set to be longer than that of the inner vertical surface 743. Also, the inner vertical surface 743 may be disposed to face the first outer vertical surface 748*a***.

A thickness between the first outer vertical surface 748*a* and the inner vertical surface 743 in the cleaning part 740 may be thickest. This may be for maintaining a coupled state between the frame 760 and the core part 750 without deformation of a portion between the first outer vertical surface 748*a* and the inner vertical surface 743 in the cleaning part 740.

The inner circumference surface of the cleaning part 740 may further include a second inner inclined surface 744 which is upward inclined from an upper end of the inner vertical surface 743 to the outside in a radius direction thereof.

The outer circumference surface of the cleaning part 740 may further include a second outer inclined surface 748*b* which is upward inclined from an upper end of the first outer inclined surface to the outside in a radius direction thereof.

An inclined angle of the second inner inclined surface 744 may be substantially the same as that of the second outer inclined surface 748*b*. Also, an inclined angle of the second inner inclined surface 744 may be substantially the same as that of the first outer vertical surface 748*a*.

The outer circumference surface of the cleaning part 740 may further include a second outer vertical surface 748*c* which vertically extends upward from an upper end of the second outer inclined surface 748*b*.

An upper end of the second outer vertical surface 748*c* may be connected to an upper end of the second inner inclined surface 744 by the upper surface 746.

The upper end of the second outer vertical surface 748*b* and the upper end of the second inner inclined surface 744 may be disposed at the same height. Therefore, the upper surface 746 of the cleaning part 740 may be a horizontal surface.

A coupling projection 745 which is to be coupled to the core part 750 may be provided on the second inner inclined surface 744.

A plurality of coupling projections 745 may be arranged apart from one another in a circumference direction of the cleaning part 740 so that a coupling force between the core part 750 and the cleaning part 740 increases.

Each of the coupling projections 745 may protrude from the second inner inclined surface 744 in a horizontal direction. That is, an extension direction of the coupling projection 745 may form a certain angle with respect to a normal line of the second inner inclined surface 744.

In a case where the coupling projection 745 extends from the second inner inclined surface 744 in the horizontal direction, the coupling projection 745 may be effectively prevented from being detached from the core part 750 in a process where the cleaning part 740 moves in a vertical direction.

A portion of the first outer inclined surface 748 in the cleaning part 740 may be recessed inward. For example, the first outer inclined surface 748 may include a recessed portion 747.

A function and a position of the recessed portion 747 will be described below with reference to the drawings.

Core Part

The core part 750 may contact a portion of each of the upper surface 746 and the inner circumference surface of the cleaning part 740.

For example, the core part 750 may include an outer inclined surface 758 which contacts the second inner inclined surface 744 of the cleaning part 740.

The outer inclined surface 758 may be upward inclined to the outside in a radius direction thereof as a lower portion thereof is closer to an upper portion thereof.

An inclined angle of the outer inclined surface 758 may be the same as that of the second inner inclined surface 744 of the cleaning part 740. The whole of the outer inclined surface 758 may contact the second inner inclined surface 744.

The core part 750 may further include an inner vertical surface 751 which vertically extends upward from a lower end of the outer inclined surface 758. The inner vertical surface 751 may be aligned with the inner vertical surface 743 of the cleaning part 740 in a vertical direction.

For example, the inner vertical surface 751 of the core part 750 and the inner vertical surface 743 of the cleaning part 740 may each be a surface which is continuous in a vertical direction.

The core part 750 may further include an inner inclined surface 752 which is upward inclined from an upper end of the inner vertical surface 751 to the outside. An inclined angle of the inner inclined surface 752 may be substantially the same as that of the outer inclined surface 758.

The core part 750 may further include a coupling hole 753 into which the coupling projection 745 of the cleaning part 740 is inserted. For example, a plurality of coupling holes 753 may be disposed apart from one another in a circumference direction of the core part 750.

The plurality of coupling holes 753 may pass through the core part 750 in a horizontal direction. That is, an extension direction of the coupling hole 753 may form a certain angle with respect to a normal line of each of the outer inclined surface 758 and the inner inclined surface 752.

A portion of each of the coupling holes 753 may pass through the outer inclined surface 758 and the inner inclined surface 752, and another portion may pass through the outer inclined surface 758 and the inner vertical surface 743.

The core part 750 may further include a horizontal surface 757 which horizontally extends outward from an end portion of the outer inclined surface 758.

A radius-direction length of the horizontal surface 757 may be longer than that of the upper surface 746 of the cleaning part 740.

The horizontal surface 757 of the core part 750 may contact the upper surface 746 of the cleaning part 740. In this case, a front surface of the upper surface 746 of the cleaning part 750 may contact the horizontal surface 757 of the core part 750.

The core part 750 may further include an outer vertical surface 756 which vertically extends upward from an outer end portion of the horizontal surface 757.

An upper surface 754 of the core part 750 may connect an upper end of the outer vertical surface 756 to an upper end of the inner inclined surface 752.

In this case, the upper end of the outer vertical surface 756 and the upper end of the inner inclined surface 752 may be disposed at the same height. Therefore, the upper surface 754 of the core part 750 may be a horizontal surface.

The core part 750 may further include a hook coupling slot 755 to which a coupling hook 782 of the frame 760 is to be coupled.

A plurality of hook coupling slots 755 may be arranged apart from one another in a circumference direction of the core part 750 so that a fastening force between the core part 750 and the frame 760 increases.

Each of the hook coupling slots 755 may be formed as the upper surface 754 of the core part 750 is recessed downward. Alternatively, each hook coupling slot 755 may be provided to pass through an upper portion of the outer vertical surface 756 and an upper portion of the inner inclined surface 752.

In all cases, the coupling hook 782 of the frame 760 may be seated on a floor surface of each hook coupling slot 755.

The core part 750 may further include a recessed portion 757 which is provided at a position corresponding to the recessed portion 747 of the first outer inclined surface 748.

Frame

The frame 760 may support the cleaning part 740 and may be coupled to the core part 750 to fix a position of the cleaning part 740.

The frame 760 may include an inner body 761*a* which supports the cleaning part 740 and an outer body 761*b* which extends downward from an upper portion of the inner body 761*a* and is disposed outside the inner body 761*a*.

The inner body 761*a* may be wholly provided to be inclined to the outside in a radius direction thereof as a lower portion thereof is closer to an upper portion thereof, and the outer body 761*b* may have a shape which vertically extends from an upper portion to a lower portion of the inner body 761*a*.

The inner body 761*a* may include an inner body bottom 761. The inner body bottom 761 may be, for example, a horizontal surface.

The inner body 761*a* may include a first inner vertical surface 761*c* which vertically extends upward from an inner end portion of the inner body bottom 761. The first inner vertical surface 761*c* may contact the first outer vertical surface 748*a* of the cleaning part 740.

The inner body bottom 761 may be disposed to be higher than the lower surface 749 of the cleaning part 740. Therefore, in terms of the whole of the movable part 730, the lower surface 749 of the cleaning part 740 may be disposed at a lowermost portion.

The inner body 761*a* may further include a first inner inclined surface 761*d* which is upward inclined from an upper end of the first inner vertical surface 761*c* to the outside in a radius direction thereof.

Moreover, the inner body 761*a* may further include a second inner vertical surface 761*e* which vertically extends upward from an upper end of the first inner inclined surface 761*d*.

Moreover, the inner body 761*a* may further include a horizontal surface 780 which horizontally extends outward from an upper end of the second inner vertical surface 761*e*.

The second outer inclined surface 748*b* of the cleaning part 740 may be seated on the first inner inclined surface 761*d*.

The second outer vertical surface 748*c* of the cleaning part 740 may contact the second inner vertical surface 761*e*.

The horizontal surface 780 of the inner body 761*a* may be disposed at the same height as the upper end 749 of the cleaning part 740.

Therefore, the horizontal surface 757 of the core part 750 may be seated on the horizontal surface 780 of the inner body 761*a* and the upper surface 749 of the cleaning part 740.

That is, a portion of the inner body 761*a* and a portion of the core part 750 may be coupled to each other to surround a portion of an upper portion of the cleaning part 740.

The inner body 761*a* may further include a second inner vertical surface 781 which vertically extends upward from an outer end portion of the horizontal surface 780.

The second inner vertical surface 781 of the inner body 761*a* may contact the outer vertical surface 756 of the core part 750. In this case, a vertical length of the second inner vertical surface 781 may be set to be longer than that of the outer vertical surface 756 of the core part 750.

Therefore, the whole of the outer vertical surface 756 of the core part 750 may contact the second inner vertical surface 781.

The coupling hook 782 may be coupled to the second inner vertical surface 781 of the inner body 761*a*. The plurality of coupling hooks 782 may be disposed apart from one another in a circumference direction thereof from the second inner vertical surface 781.

Each coupling hook 782 may protrude inward from an upper portion of the second inner vertical surface 781.

Therefore, according to the present embodiment, the upward movement of an upper portion of the core part 750 may be limited by the coupling hook 782, and the downward movement of a lower portion of the core part 750 may be limited by the horizontal surface 780 of the inner body 761*a*.

The outer body 761*b* may be disposed outside the inner body 761*a*, and in this case, may surround a portion of the inner body 761*a* without surrounding the whole of the inner body 761*a*.

In this case, a portion where the outer body 761*b* is not provided may be a portion adjacent to the suction part 5 in the main body 2.

Moreover, a recessed portion 767 recessed inward may be provided at a portion, which is not surrounded by the outer body 761*b*, of the inner body 761*a*. The recessed portion of the inner body 761*a* may be provided at a position at which the recessed portion 757 of the core part 750 corresponds to the recessed portion 747 of the cleaning part 740.

A height of a portion, where the recessed portion 767 is provided, of the inner body 761*a* may be lower than that of a portion, where the recessed portion 767 is not provided, of the inner body 761*a*.

At least some of the recessed portions 767, 757, and 747 in the movable part 730 may be disposed to face the suction part 5 and may be recessed in a direction distancing from the suction part 5.

The inner body 761*a* and the outer body 761*b* may be connected to each other by one or more connection ribs 769 so as to prevent relative deformation between the inner body 761*a* and the outer body 761*b* from being performed due to a reaction occurring in a process where the movable part 730 is lowered to compress dust in the dust container 112.

The frame 760 may further include a frame guide 765 which extends downward from a boundary portion between the inner body 761*a* and the outer body 761*b*.

A vertical length of the frame guide 765 may be set to be longer than that of each of the inner body 761*s* and the outer body 761*b*. Also, a lower end of the frame guide 765 may be disposed to be lower than the inner body 761*a* and the outer body 761*b*.

The frame guide 765 may include a guide surface 765*a* which is a flat surface. The guide surface 765*a* may guide spiral air flow in a process where air flows into the first cyclone part 110 through the suction part 5. Disposition of the frame guide 765 will be described below with reference to the drawings.

A lower end of the frame guide 765 may be disposed to be lower than the inner body 761*a* and the outer body 761*b*, and thus, the frame guide 765 may downward pressurize dust stored in the dust container 112 in a process where the movable part 730 is lowered.

The frame 760 may further include a pressurization rib 762 which extends downward from the outer body 761*b*. The pressurization rib 762 may be provided to be rounded in a circumference direction thereof.

The pressurization rib 762 may downward pressurize the dust stored in the dust container 112 in a process of lowering the movable part 730.

In this case, the pressurization rib 762 may be provided in a thin plate shape, and thus, a pressurization area where the pressurization rib 762 pressurizes dust may be narrow. Therefore, the frame 760 may further include one or more auxiliary ribs 762*a* which protrudes inward from an inner circumference surface of the pressurization rib 762, for increasing a dust-compressing area.

In order to more increase a dust compression effect, the plurality of auxiliary ribs 762*a* may be disposed apart from one another in a circumference direction from the pressurization rib 762.

Each of the auxiliary ribs 762*a* may extend from a portion under the connection rib 769, or may connect the inner body 761*a* to the outer body 761*b* independently from the connection rib 769 and may extend to the pressurization rib 762.

The auxiliary rib 762*a* may include an inclined surface 762*b* so as not to hinder flow of air at the standby position but to compress dust.

For example, the inclined surface 762*b* may be downward inclined from the auxiliary rib 762*a* to the outside in a radius direction thereof. That is, a protrusion length of the auxiliary rib 762*a* may be reduced in a direction closer to a lower portion thereof.

Moreover, a lower end of the auxiliary rib 762*a* may be disposed to be higher than a lower end of the pressurization rib 762.

The frame 760 may further include an extension part 763 which extends outward from the pressurization rib 762 and a coupling part 764 which is provided in the extension part 763.

In the present embodiment, the extension part 763 and the coupling part 764 may be referred to as a connection part for connecting the transfer part 720 to the frame 760.

The transfer part 720 may be connected to the coupling part 764.

The extension part 763, for example, may extend outward from a lowermost portion of an outer circumference surface of the pressurization rib 762. In this case, an extension line of the extension part 763 may pass through a center of the frame 760.

Therefore, a moment may be prevented from occurring in a process where the manipulation force of the manipulation part 710 is transferred to the frame 760 by the transfer part 720.

A horizontal thickness of the extension part 763 may be set to be less than a diameter of the coupling part 764.

The coupling part 764 may be approximately cylindrical in shape. An accommodating groove 764*a* for accommodating the transfer part 720 may be provided in the coupling part 764. The accommodating groove 764*a* may be recessed downward from an upper surface of the coupling part 764.

The transfer part 720, as described above, may be provided in a long bar shape which is a cylindrical shape. This may be for enabling the transfer part 720 to smoothly move in a process where the transfer part 720 moves in a state which passes through the guide body 180.

Therefore, a lower end of the transfer part 720 may be inserted into the accommodating groove 764*a* at an upper portion of the coupling part 764.

The coupling part 764 may further include a seating surface 764*b* on which a lower end of the transfer part 720 accommodated into the accommodating groove 764*a* is seated.

A fastening member S1 may be fastened to the transfer part 720 at a lower portion of the coupling part 764 in a state where the transfer part 720 is accommodated into the accommodating groove 764*a* and is seated on the seating surface 764*b*. The fastening member S1 may be, for example, a bolt.

An accommodating groove 764*c* to receive a head of the bolt accommodated thereinto may be provided in a floor of the coupling part 764. Also, a fastening groove 722 to which the fastening member S1 is fastened may be provided in the transfer part 720.

Therefore, the fastening member S1 may pass through a fastening hole 764*d* passing through the accommodating groove 764*c* and the seating surface 764*b* and may be fastened to the fastening groove 722 of the transfer part 720.

The transfer part 720 may be apart from an outer circumference surface (an outer circumference surface of an outer body) of the frame 760 in a state where the transfer part 720 is coupled to the coupling part 764.

In the present embodiment, the cleaning part 740 may be provided as one body with the core part 750 and the frame 760 through double injection.

Figure 15:
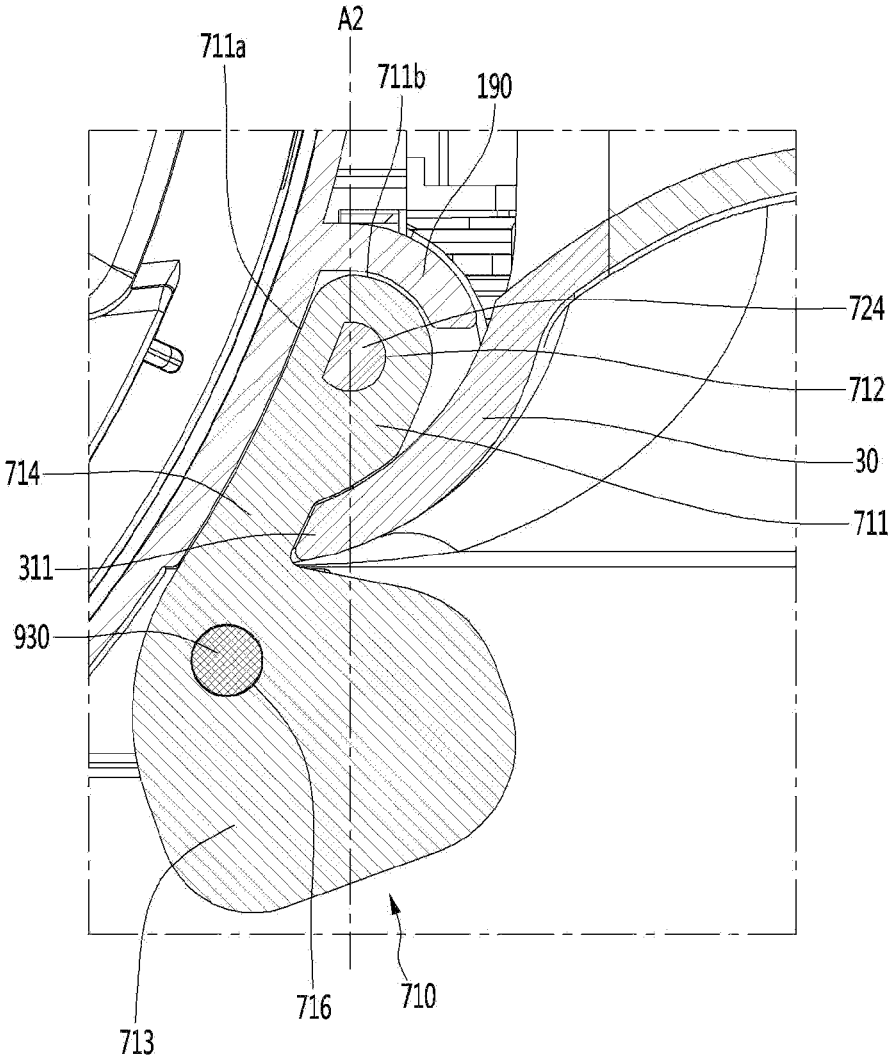
FIG. 15 is a cross-sectional view taken along line D-D of FIG. 1.
Figure 16:
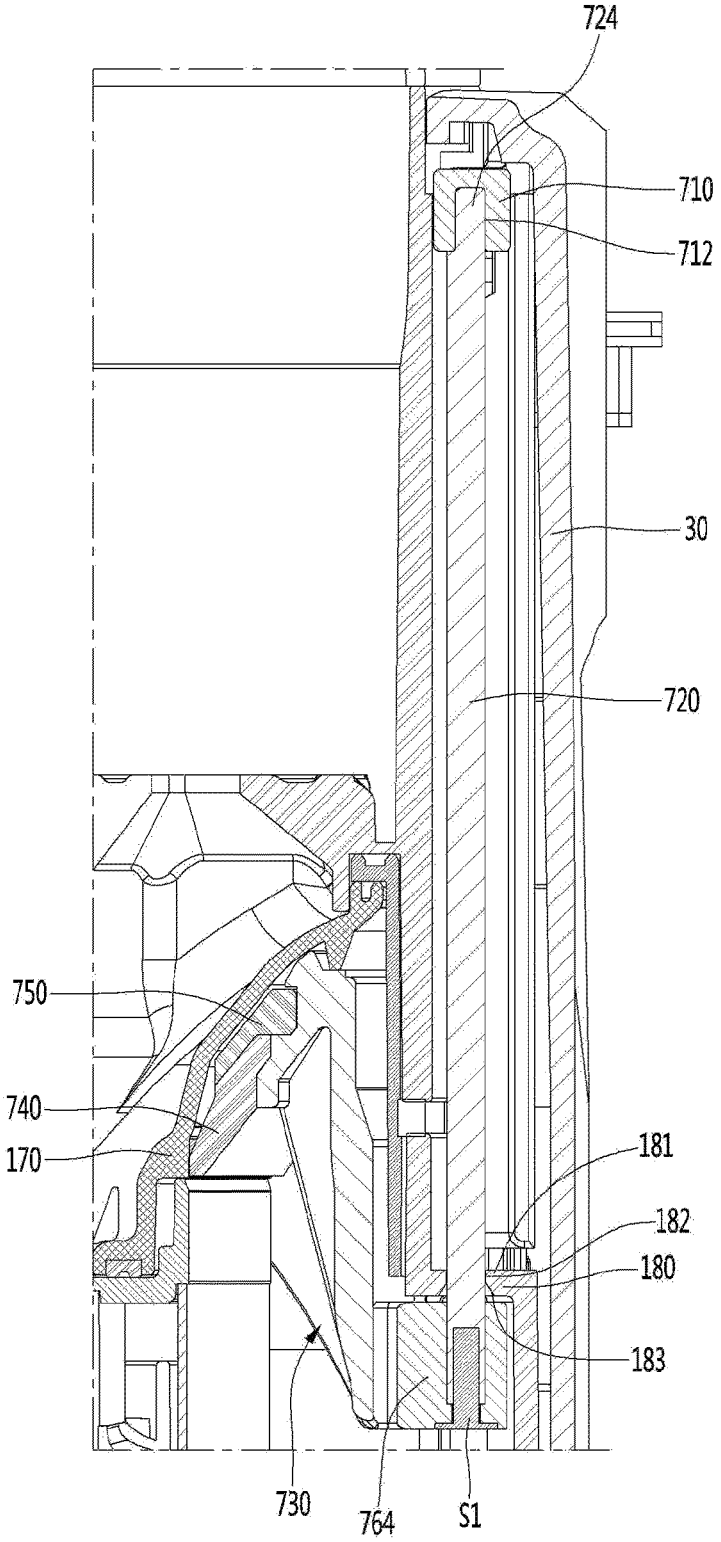
FIG. 16 is a cross-sectional view taken along line E-E of FIG. 1.
Figure 17:
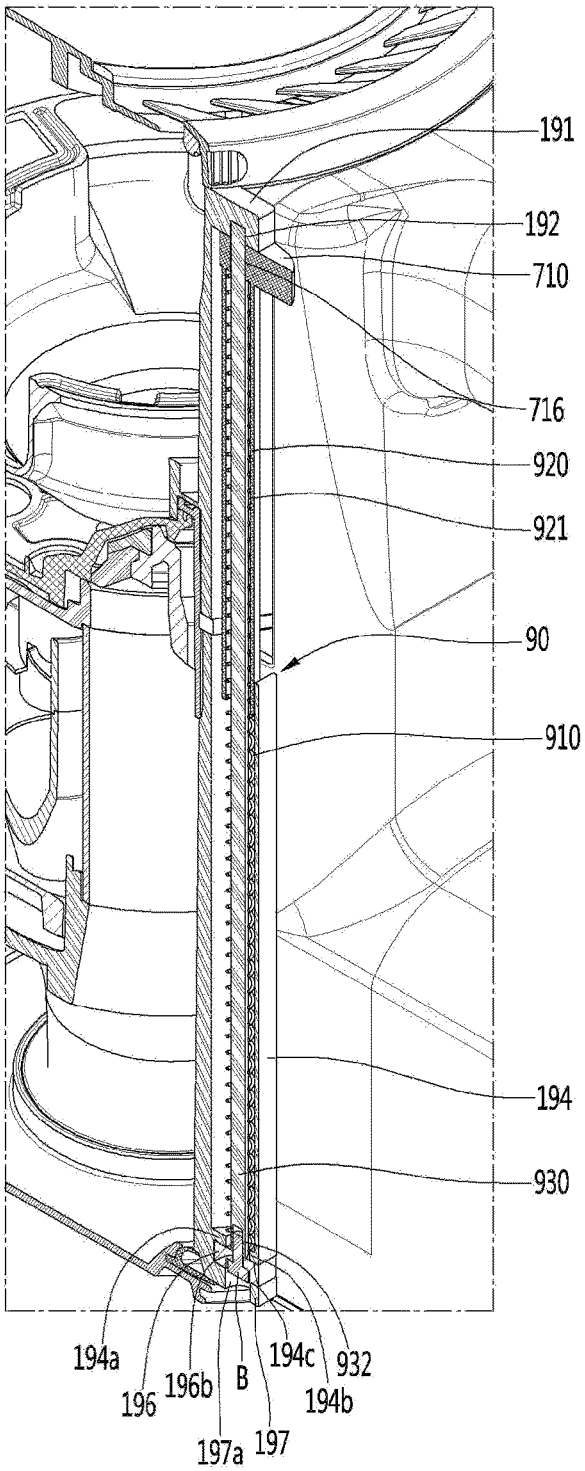
FIG. 17 is a cross-sectional view taken along line F-F of FIG. 1.

FIG. 15 is a cross-sectional view taken along line D-D of FIG. 1, FIG. 16 is a cross-sectional view taken along line E-E of FIG. 1, and FIG. 17 is a cross-sectional view taken along line F-F of FIG. 3.

Referring to FIGS. 1 and 15 to 17, the manipulation part 710 may include a first part 711 which is disposed within the handle part 3 and a second part 713 which extends from the first part 711 in a horizontal direction and is disposed outside the handle part 3.

Since the second part 713 is disposed outside the handle part 3, a user may press an upper surface of the second part 713. In the manipulation part 710, the second part 713 may be referred to as a press part.

Moreover, the manipulation part 710 may be disposed to be higher than the movable part 730. Although not limited, the manipulation part 710 may be disposed close to an upper surface of the handle part 3. Therefore, the user may easily check the manipulation part 710 to press the manipulation part 710.

The first part 711 may include a first side part 711*a* which faces an outer circumference surface of the second main body 20 and is provided to have substantially the same as curvature as that of the outer circumference surface of the second main body 2.

The second main body 20 may include a guide rib 190 which guides a portion of the first part 711. The guide rib 190 may protrude from the outer circumference surface of the second main body 20 and may extend in a vertical direction.

The guide rib 190 may be rounded in a horizontal direction in order for first part 711 to stably move upward and downward. Therefore, the first part 711 may further include a second side part 711*b* which is rounded to have substantially the same curvature as that of the guide rib 190.

In the present embodiment, the first side part 711*a* of the first part 711 may contact the second main body 20, and the second side part 711*b* of the first part 711 may contact the guide rib 190.

When the manipulation part 710 is lowered in a state where a plurality of points of the first part 711 contact a peripheral structure, a phenomenon where the manipulation part 710 is inclined in a horizontal direction in a lowering process may be prevented, and thus, the manipulation part 710 may be stably lowered (the same as a raising case).

The transfer part 720 may be connected to the first part 711. A fitting groove 712 into which a portion of the transfer part 720 is fitted may be provided in the first part 711.

In order to prevent a relative rotation of each of the transfer part 720 and the manipulation part 710 in a process of manipulating the manipulation part 710, a horizontal cross-sectional surface of a portion 724, into which the fitting groove 712 is inserted, of the transfer part 720 may be provided in a noncircular shape.

Therefore, a cross-sectional surface of the fitting groove 712 may be provided in a non-circular shape. The fitting groove 712 may be formed by upward recessing a lower surface of the first part 711.

The manipulation part 710 may further include a neck part 714 provided between the first part 711 and the second part 713.

The neck part 714 may be provided to have a width which is narrower than a horizontal-direction width of each of the first part 711 and the second part 713. The neck part 714 may be disposed in the slot 310 of the handle part 3.

The handle body 30 may include a guide end part 311 which contacts the neck part 714 in a state where the neck part 714 is disposed in the slot 310.

One side of the neck part 714 may contact the outer circumference surface of the second main body 20, and the other side thereof may contact the guide end part 311. The guide end part 311 may surface-contact the neck part 714.

When the guide end part 311 contacts the neck part 714 of the manipulation part 710 as described above, a phenomenon where the manipulation part 710 is inclined in a left-right direction and rotates in a horizontal direction may be prevented, and thus, the manipulation part 710 may be stably lowered (the same as a raising case).

Since a user should press the second part 713, a horizontal-direction width of the second part 713 may be provided to be greater than that of the first part 711.

Moreover, the second part 713 may be bent to distance from the outer circumference surface of the second main body 20 with respect to the neck part 714, so that a space enabling the second part 713 to be pressed is secured at a boundary portion between the second main body 20 and the handle body 30.

Therefore, the second part 713 may be apart from the outer circumference surface of the second main body 20. That is, the second part 713 may include a side part which is rounded in a direction distancing from the outer circumference surface of the second main body 20.

Since the second part 713 is bent to distance from the outer circumference surface of the second main body 20, the second part 713 may be lowered while covering the slot 310 in a process of lowering the manipulation part 710, thereby minimizing a degree to which an internal structure of the handle part 3 is exposed at the outside through the slot 310.

Referring to FIG. 15, a virtual line A2 which extends in a tangential direction with respect to the outer circumference surface of the second main body 20 and passes through the transfer part 720 may be disposed to pass through the second part 713 or to overlap the second part 713 in a vertical direction.

Moreover, the second part 713 may be bent at the neck part 714 so that the second part 713 of the manipulation part 710 is disposed to the left of the handle part 3 and is disposed close to the handle part 3 in a state where a right hand grips the handle part 3. Accordingly, the user may easily check and manipulate the second part 713 of the manipulation part 710.

The compression mechanism 70 may further include a supporting mechanism 90 for elastically supporting the manipulation part 710.

The supporting mechanism 90 may include an elastic member 910 for providing an elastic force to the manipulation part 710. The elastic member 910 may elastically support the manipulation part 710 with being apart from the transfer part 720 in a horizontal direction.

For example, the transfer part 720 may be covered by the handle body 30, and the elastic member 910 may be disposed outside the handle body 30.

The elastic member 910 may be, for example, a coil spring and may contract and expand in a vertical direction.

In this case, at an initial position of the manipulation part 710 (a position of the manipulation part 710 before the user pressurizes the manipulation part 710), a length of the elastic member 910 may be set to be longer than that of the transfer part 720. When a length of the elastic member 910 is longer than that of the transfer part 720, the manipulation part 710 may be supported by using the elastic member 910 having a low elastic coefficient.

In this case, when the user pressurizes the manipulation part 710, a desired force may be reduced. Also, when the manipulation part 710 returns to an original position by using the elastic member 910, a noise sound caused by collision between the manipulation part 710 and a below-described stopper may be reduced.

The supporting mechanism 90 may further include an extension body 920 which accommodates an upper portion of the elastic member 910.

The extension body 920 may extend in a vertical direction, and a space 921 for accommodating the elastic member 910 may be provided in the extension body 920. For example, the extension body 920 may be provided in a cylindrical shape.

The extension body 920 may extend downward from a lower surface of the manipulation part 710. The extension body 920 may be provided as one body with the manipulation part 710, or may be coupled to the manipulation part 710. That is, the extension body 920 may move upward and downward along with the manipulation part 710.

An upper end of the elastic member 910 may contact the extension body 920, or may contact the lower surface of the manipulation part 710. In FIG. 17, an example where an upper end of the elastic member 910 contacts the lower surface of the manipulation part 710 is illustrated.

Therefore, in a process of manipulating the manipulation part 710, a manipulation force of the manipulation part 710 may be transferred to the elastic member 910, and thus, the elastic member 910 may be pressurized.

The main body 2 may further include a stopper 191 for limiting the vertical movement of the manipulation part 710.

The stopper 191 may protrude from the outer circumference surface of the main body 2, and the upper surface of the manipulation part 710 may contact a lower surface of the stopper 191.

In a state where the manipulation force for downward pressurizing the manipulation part 710 is not applied, the manipulation part 710 may maintain a state which contacts the lower surface of the stopper 191, based on the elastic force of the elastic member 910.

As described above, in a state where the manipulation part 710 contacts the stopper 191, the extension body 920 may surround a portion of the elastic member 910.

Therefore, a portion, surrounded by the extension body 920, of the elastic member 910 may not be exposed at the outside.

That is, the elastic member 910 may be accommodated into the extension body 920. In this case, the elastic member 910 may be apart from or contact an inner surface of the extension body 920.

When the elastic member 910 contacts the inner surface of the extension body 920, the horizontal-direction movement of the elastic member 910 may be limited by the extension body 920 in a process of contracting or expanding the elastic member 910.

Alternatively, although the elastic member 910 is apart from the inner surface of the extension body 920, when the elastic member 910 contacts the inner surface of the extension body 920 in a process of contracting or expanding the elastic member 910, the horizontal-direction movement of the elastic member 910 may be limited.

The body 2 may further include a cover body 194 which surrounds a lower portion of the elastic member 910.

The cover body 194 may protrude from the main body 2. For example, the cover body 194 may be provided to be convex from the main body 2 in a radius direction thereof.

In a state where the manipulation force for downward pressurizing the manipulation part 710 is not applied, namely, at a manipulation standby position of the manipulation part 710, a portion of a lower portion of the extension body 920 may overlap the cover body 194 in a horizontal direction.

For example, at the manipulation standby position of the manipulation part 710, a portion of the lower portion of the extension body 920 may be accommodated into an internal space of the cover body 194.

Moreover, in a process of downward moving the manipulation part 710, the extension body 920 may be disposed in the internal space of the cover body 194. The extension body 920 may move downward and upward in the internal space of the cover body 194.

The cover body 194 may include an elastic member supporting surface 194*a* on which a lower end of the elastic member 910 is stably disposed.

In the present embodiment, the extension body 920 may be disposed inward from the cover body 194, an upper portion of the elastic member 910 disposed in the extension body 920 may be apart from an inner surface of the cover body 194.

In this case, an interval between the inner surface of the cover body 194 and the elastic member 910 may be set to be greater than a thickness of the extension body 920.

This may be for allowing the extending body 920 lowered along with the manipulation part 710 to be disposed between the inner surface of the cover body 194 and the elastic member 910 in a process of lowering the manipulation part 710.

However, since the elastic member 910 is apart from the inner surface of the cover body 194, the elastic member 910 may contact the cover body 194 before the extension body 920 moves to a space between the elastic member 910 and the cover body 194 in a process where the manipulation part 710 moves downward and thus the elastic member 910 contracts.

In this case, interference may occur between the elastic member 910 and the extension body 920, and due to this, the manipulation part 710 may not be lowered at a certain position any longer and the elastic member 910 may be pressurized and deformed by the extension body 920.

Therefore, the supporting mechanism 90 may further include a supporting bar 930 for supporting the elastic member 910, so that the horizontal-direction movement of the elastic member 910 is limited in a process of vertically moving the manipulation part 710.

The supporting bar 930 may be provided in, for example, a cylindrical shape. Also, a vertical length of the supporting bar 930 may be set to be longer than that of the elastic member 910.

The elastic member 910 may be disposed to surround the supporting bar 930.

That is, the supporting bar 930 may be disposed in an internal region of the elastic member 910 having a coil shape. An outer diameter of the supporting bar 930 may be equal to or less than an inner diameter of the elastic member 910.

One end of the supporting bar 930 may be coupled to the stopper 191. A coupling groove 192 to which an upper end of the supporting bar 930 is coupled may be provided in a lower surface of the stopper 191. The coupling groove 192 may be formed by upward recessing the lower surface of the stopper 191. Also, the upper end of the supporting bar 930 may be inserted into the coupling groove 192.

The supporting bar 930 may pass through the manipulation part 710 and may be coupled to the stopper 191.

For example, when the supporting bar 930 passes through the manipulation part 710, the supporting bar 930 may guide the vertical movement of the manipulation part 710.

Therefore, the supporting bar 930 may be referred to as a guide bar.

The manipulation part 710 may further include a through hole 716 in order for the supporting bar 930 to pass therethrough.

A lower portion of the supporting bar 930 may be coupled to the elastic member supporting surface 194*a* of the cover body 194.

Alternatively, the cover body 194 may include a space 194*c* which is provided in a lower surface of the elastic member supporting surface 194*a*, and the coupling member 196 may be inserted into the space 194*c*. One side of the space 194*c* may be opened, and the coupling member 196 may be inserted into the space 194*c* through an opening.

Moreover, an opening 197*a* may be provided in a floor 197 of the space 194*c*, and a hole 194*b* may be provided in the elastic member supporting surface 194*a*. The opening 197*a*, the space 194*c*, and the hole 194*b* may be aligned in a vertical direction.

Therefore, the supporting bar 930 may sequentially pass through the opening 197*a*, the space 194*c*, and the hole 194*b* at a portion under the opening 197*a*.

In a state where the supporting bar 930 is coupled to the stopper 191, the supporting bar 930 may be disposed in the hole 194*b*.

Moreover, when the coupling member 196 is inserted into the space 194*c*, a lower end of the supporting bar 930 may be stably disposed on an upper surface of the coupling member 196.

The coupling member 196 may be fastened to the supporting bar 930 by a bolt B.

The bolt B may pass through the opening 197*a* and may be fastened to the coupling member 196 and the supporting bar 930. To this end, a fastening groove 932 may be provided in a lower portion of the supporting bar 930, and a stepped fastening hole 196*b* may be provided in the coupling member 196.

In this case, the coupling member 196 may be inserted into the space 194*c* in a horizontal direction, and the bolt B may be coupled to the coupling member 196 and the supporting bar 930 in a vertical direction.

As described above, the guide body 180 may be provided outside the first body 10.

The guide body 180 may protrude from the outer circumference surface of the first body 10, and an upper sidewall 181 of the guide body 180 may overlap the transfer part 720 in a vertical direction.

Therefore, the transfer part 720 may pass through the upper sidewall 181 of the guide body 180. The upper sidewall 181 of the guide body 180 may be substantially a horizontal surface, and an opening 182 through which the transfer part 720 passes may pass through the upper sidewall 181 in a vertical direction.

That is, the transfer part 720 may pass through the opening 182 in a vertical direction and may move in a vertical direction even in a state where the transfer part 720 passes through the opening 182.

According to the present embodiment, the transfer part 720 may pass through the opening 182, and moreover, a size of the opening 182 for providing a path through which the transfer part 720 moves may be minimized, thereby preventing the internal air and dust of the first body 10 from being leaked to the outside through the opening 182.

At least a portion of the opening 182 may be provided to have a diameter which increases in a direction closer to a lower portion thereof, so that the transfer part 720 moves smoothly in a vertical direction in a state where the transfer part 720 passes through the upper sidewall 181 of the guide body 180. That is, the opening 182 may include a lower inclined surface 183. A minimum diameter of the opening 182 may be substantially the same as an outer diameter of the transfer part 720.

Therefore, the transfer part 720 may contact a portion of a perimeter surface of the opening 182 and may not contact the other portion with being disposed in the opening 182.

A contact area between the transfer part 720 and the perimeter surface of the opening 182 may be reduced, and thus, a frictional force between the perimeter surface of the opening 182 and the transfer part 720 may decrease, whereby the transfer part 720 may smoothly move upward and downward.

The coupling part 764, coupled to the transfer part 720, of the frame 760 may be disposed vertically under the opening 182. That is, the transfer part 720 passing through the opening 182 may be coupled to the coupling part 764.

A diameter of the coupling part 764 may be set to be greater than that of the opening 182.

Moreover, the coupling part 764 may contact a lower surface of the upper sidewall 181 at the standby position. Accordingly, the coupling part 764 may cover the opening 182 at the standby position.

Therefore, in a state where the movable part 730 is disposed at the standby position, the internal air and dust of the first body 10 may be effectively prevented from being leaked through the opening 182.

Figure 18:
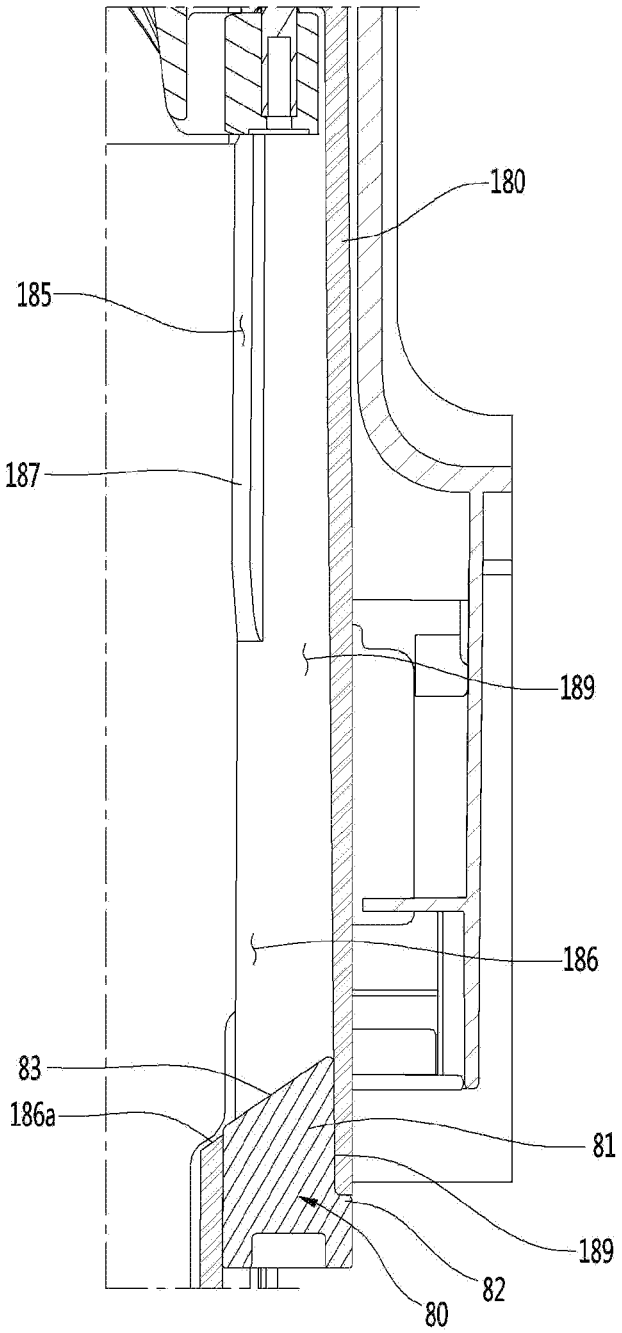
FIG. 18 is a cross-sectional view taken along line G-G of FIG. 3.
Figure 19:
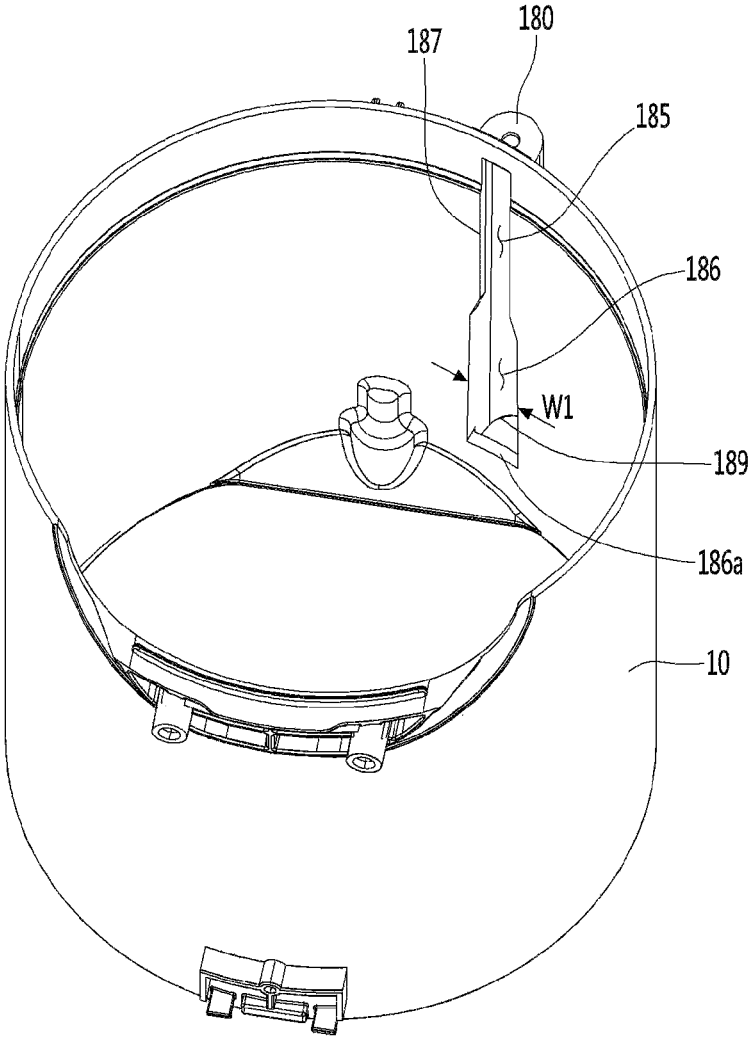
FIG. 19 is a perspective view illustrating an internal structure of a first body according to an embodiment.
Figure 20:
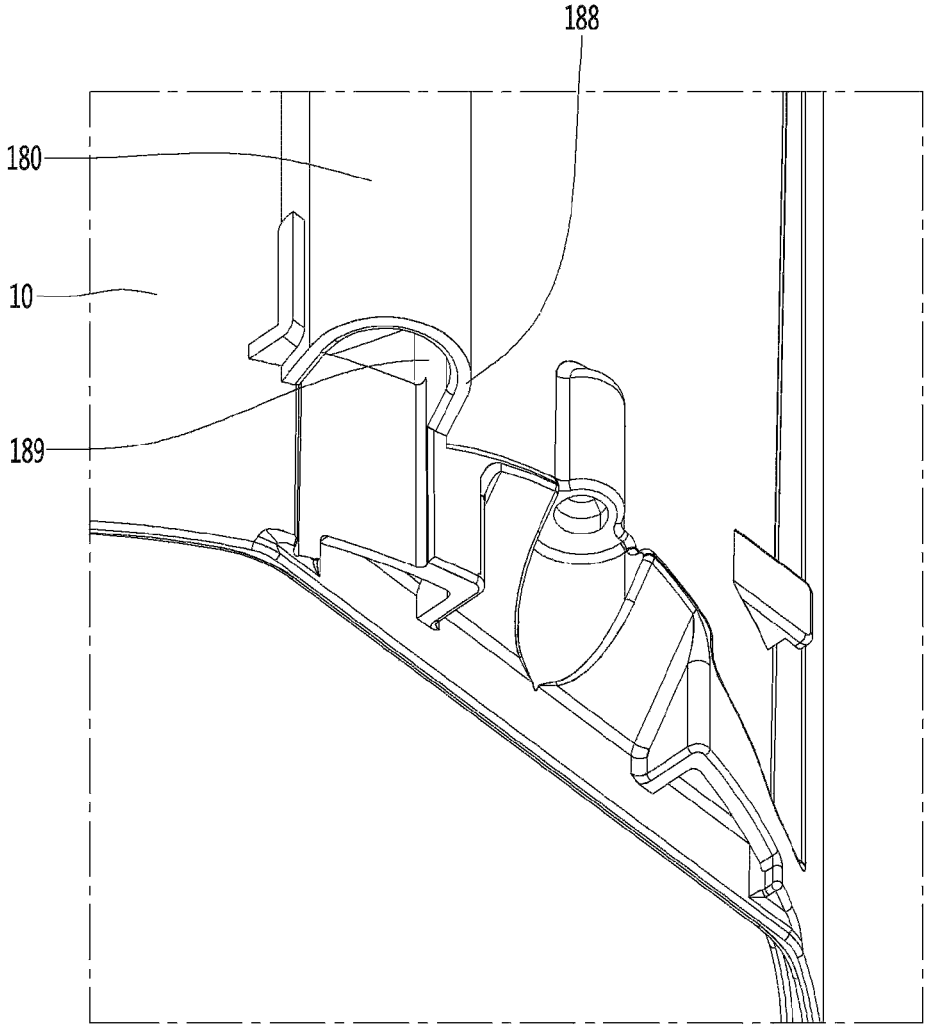
FIG. 20 is a perspective view illustrating a guide body of a first body according to an embodiment.

FIG. 18 is a cross-sectional view taken along line G-G of FIG. 3, FIG. 19 is a perspective view illustrating an internal structure of a first body according to an embodiment, and FIG. 20 is a perspective view illustrating a guide body of a first body according to an embodiment.

Referring to FIGS. 18 to 20, the guide body 180 may have a structure which is formed by outward recessing a portion of the first body 10, and the guide body 180 may provide a movement space 188 for movement of the transfer part 720 and the coupling part 764.

The guide body 180 may be rounded to be convex outward from the first body 10. That is, a horizontal cross-sectional surface of the guide body 180 may be provided in an approximately semicircular shape.

The movement space 188 may communicate with an internal space of the first body 10. The internal space of the first body 10 may communicate with the movement space 188 of the guide rib 180 through a communication hole.

The communication hole may include an upper hole 185 and a lower hole 186 which extends downward from the upper hole 185 and has a width greater than that of the upper hole 185.

The reason that a width of the lower hole 186 is set to be greater than that of the upper hole 185 is for enabling the coupling part 764 of the movable part 730 to be easily inserted into the movement space 188 through the lower hole 186. Accordingly, the assemblability of the movable part 730 may be enhanced.

For example, a width W1 of the lower hole 186 may be set to be greater than a diameter of the coupling part 764.

Moreover, an outer circumference surface of the coupling part 764 may be apart from an inner circumference surface of the guide body 180 in a state where the coupling part 764 passes through the lower hole 186. This is for preventing friction between the coupling part 764 and the inner circumference surface of the guide body 180 in a process of lowering and raising the compression mechanism 70.

The first body 10 may include a pair of ribs 187 which are apart from each other in a horizontal direction. The pair of ribs 187 may substantially define the upper hole 185. That is, the upper hole 185 may be disposed between the pair of ribs 187.

The pair of ribs 187 may be provided at a portion, corresponding to an upper space, of a movement space of the first body 10 so as to decrease a width of the upper hole 185.

An interval (i.e., a width of the upper hole 185) between the pair of ribs 187 may be set to be less than a diameter of the coupling part 764 and greater than a horizontal-direction width of the extension part 763 of the frame 760.

Therefore, when cyclone flow is rotated in an upper portion of the first body 10, the amount of dust penetrating into the movement space 188 may be minimized.

A lower sidewall 188 of the guide body 180 may be disposed at a height from a lower end of the first body 10, and a lower opening 189 may be provided in the lower sidewall 188.

In an assembly process, the lower opening 189 may provide a path through which an instrument for fastening the coupling part 764 to the transfer part 720 moves in a state where the movable part 730 is disposed in the first body 710 and the coupling part 764 is disposed in the guide body 180.

Therefore, a sealing member 80 may be coupled to the lower opening 189, for preventing the leakage of air after assembly is completed. For example, the sealing member 80 may include an inserting part 81 inserted into a space of the guide body 180 through the opening 189.

Moreover, the sealing member 80 may further include a stopper 82 having a horizontal cross-sectional area which is greater than that of the inserting part 81, for limiting an insertion depth of the inserting part 81.

The sealing member 81 may be formed of, for example, a rubber material, and thus, even without a separate coupling means, the inserting part 81 may be inserted into the guide body 180, whereby the sealing member 80 may be coupled to the guide body 180.

An upper surface of the sealing member 80 may be downward inclined in a direction closer to a center of the first body 10. That is, the sealing member 80 may include an inclined surface 83.

A lowest point of the inclined surface 83 may be disposed adjacent to the lower hole 186 and may be disposed to be higher than a lowest point 186*a* of the lower hole 186.

The movement space 188 of the guide body 180 may communicate with an internal space of the first body 10, and thus, in a cleaning process using the cleaner 1, the internal dust of the first body 10 may move to the movement space 188.

The dust which has moved to the movement space 188 may be dropped to an upper surface of the sealing member 80. In this case, the upper surface of the sealing member 80 may be the inclined surface 83, and thus, dust dropped to the inclined surface 83 of the sealing member 80 may smoothly penetrate into the first body 10.

For example, even when dust is collected on the inclined surface of the sealing member 80, the coupling part 764 may downward pressurize the dust disposed on the inclined surface 83 in an operating process of the compression mechanism 70, and thus, the dust on the inclined surface 83 may flow into the first body 10 along the inclined surface 83.

Figure 21:
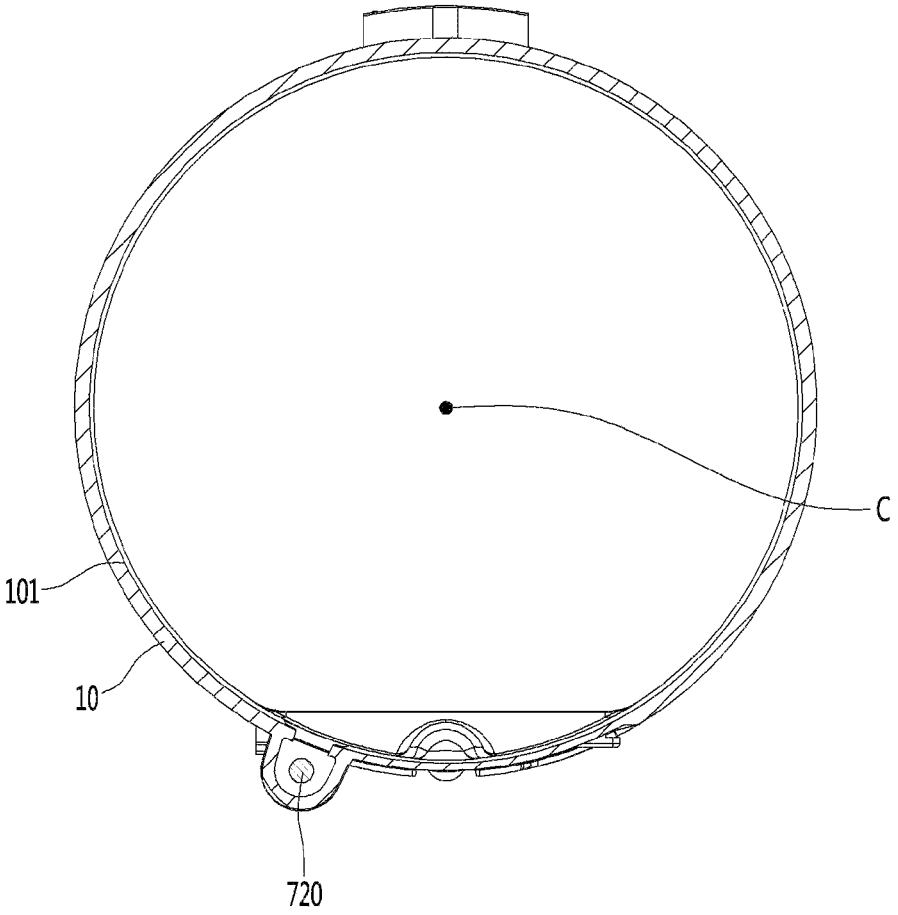
FIG. 21 is a cross-sectional view taken along line H-H of FIG. 3.
Figure 22:
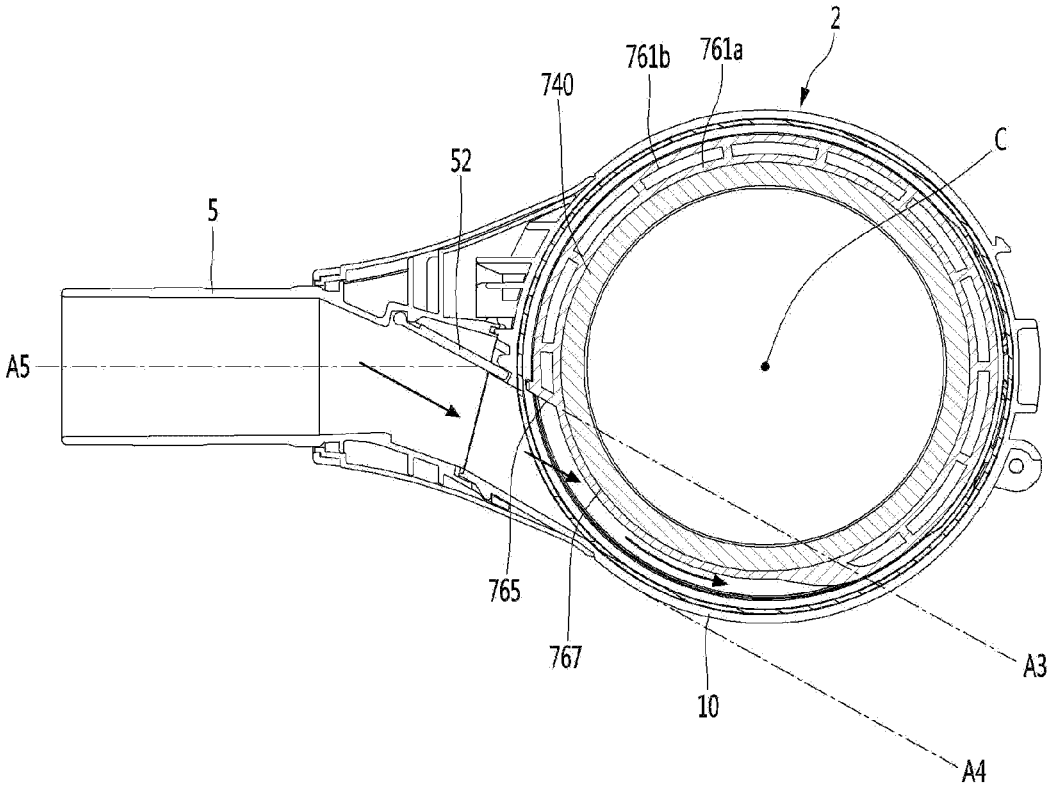
FIG. 22 is a cross-sectional view taken along line I-I of FIG. 3.

FIG. 21 is a cross-sectional view taken along line H-H of FIG. 3, and FIG. 22 is a cross-sectional view taken along line Hof FIG. 3.

Referring to FIGS. 4, 21, and 22, a lengthwise-direction axis A5 of the suction part 5 may not extend to the main body 2 in a tangential direction with the suction part 5 being coupled to the main body 2.

In order for cyclone flow to be generated in the main body 2, the air may flow into the first body 10 in the tangential direction and may move along the inner circumference surface of the first body 10.

Therefore, the suction part 5 may include an inflow guide 52 for guiding air, flowing in the suction part 5, to flow into the first body 10 in the tangential direction.

Therefore, a direction of air flowing along the suction part 5 may be changed by the inflow guide 52, and the air may flow into the first body 10.

In the present embodiment, in a state where the compression mechanism 70 moves to the standby position, at least a portion of the movable part 730 may be disposed to face the suction part 5. That is, with respect to a floor of the main body 2, at least a portion of the movable part 730 may be disposed at the same height as the suction part 5.

The movable part 730 may be disposed at a position which does not face the suction part 5, but in this case, there may be a problem where a height of the main body 2 increases.

The filter part 130 may be cleaned by the movable part 730 in a state where the movable part 730 is disposed in a space between the outer circumference surface of the filter part 130 and the inner circumference surface 101 of the first body 10 in a cleaning process.

Therefore, the outer circumference surface of the movable part 730 may be disposed adjacent to the inner circumference surface 101 of the first body 10.

When the movable part 730 is disposed on a path from the suction part 5 to the first body 10, the movable part 730 may act as a flow resistor, and due to this, flow performance may decrease.

Therefore, in the present embodiment, in order to minimize a degree to which the movable part 730 acts as a flow resistor of air flowing into the first body 10, the recessed portion 767 for increasing a space between the inner circumference surface 101 of the first body 10 and the outer circumference surface of the movable part 730 may be provided in the movable part 730 as described above.

In detail, the recessed portion 767 may be disposed at a portion disposed between a first extension line A3 of the inflow guide 52 and a second extension line A4 which extends in a tangential direction of the first body 10 in parallel with the first extension line A3, in the movable part 730. In this case, the first extension line A3 may be disposed between the second extension line A4 and a center of the first body 10.

Therefore, a space between the outer circumference surface of the movable part 730 and the inner circumference surface 101 of the first body 10 may increase by a recessed depth of the recessed portion 767. Accordingly, air flowing into the first body 10 through the suction part 5 may be prevented from directly colliding with the movable part 730.

In order for the frame guide 765 to continuously guide air flowing along the inflow guide 52, the frame guide 765 may be disposed on the first extension line A3, or an extension direction of the frame guide 765 may be parallel to the first extension line A3.

Since the movable part 730 should be disposed in a space between the filter part 130 and the inner circumference surface 101 of the first body 10, movement of the movable part 730 should be performed without an increase in a size of the first body 10.

Therefore, in the present embodiment, the movable part 730 may be disposed inward in a radius direction of the inner circumference surface 101 which is a surface enabling cyclone flow to be generated in the first body 10, and the transfer part 720 may be disposed outward in the radius direction of the inner circumference surface 101 which is a surface enabling cyclone flow to be formed in the first body 10. Also, the transfer part 720 may be connected to the movable part 730 by the extension part 763 and the coupling part 764 of the frame 760.

That is, the transfer part 720 may be disposed outward in a radius direction of an inner circumference surface where cyclone flow is generated in the first cyclone part 110 and may be disposed outward in a radius direction of an inner circumference surface of the dust container 112.

Therefore, interference between the transfer part 720 and an internal structure of the first body 10 may be prevented in a process of transferring, by transfer part 720, the manipulation force of the manipulation part 710 to the movable part 730.

Figure 23:
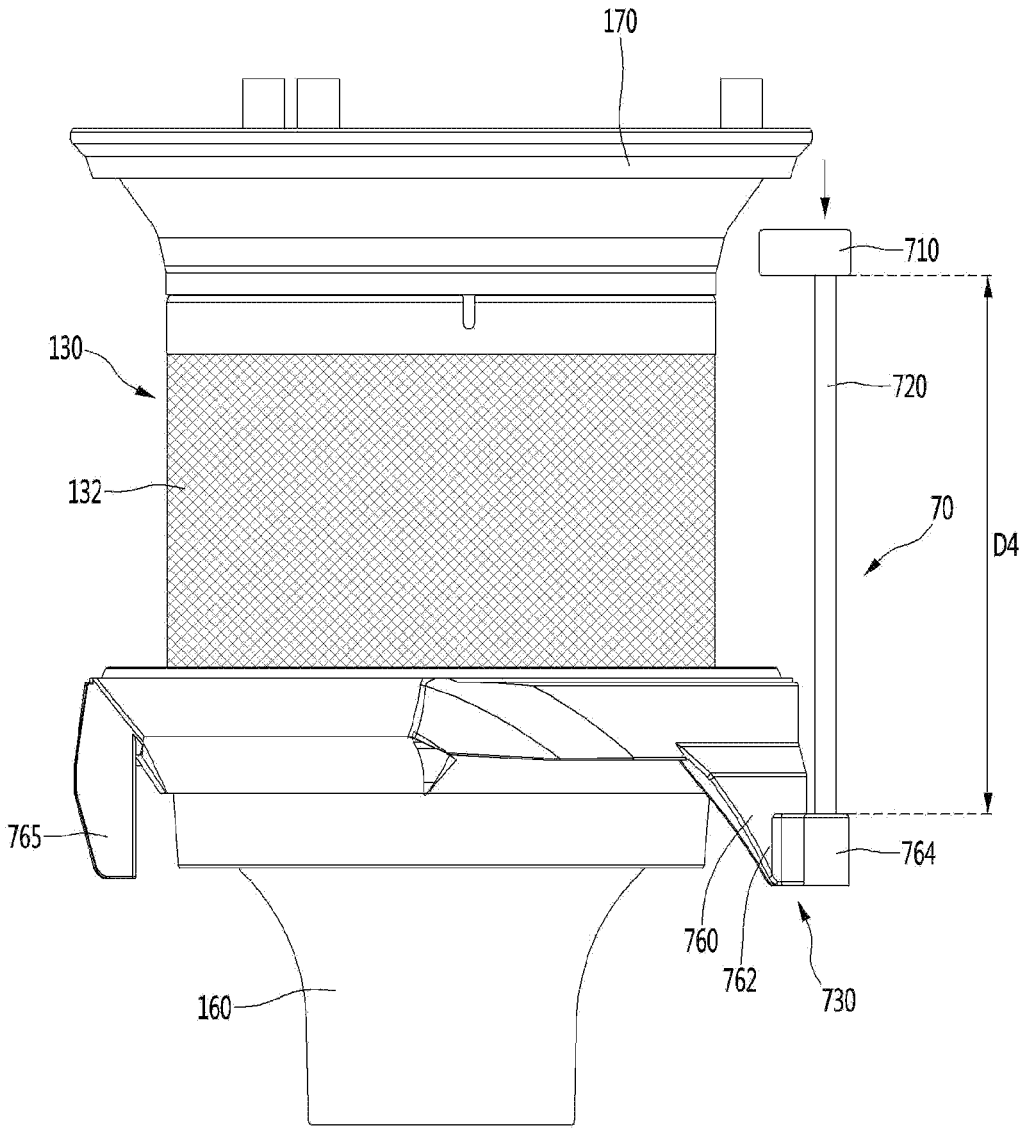
FIG. 23 is a diagram illustrating positions of a compression mechanism and a filter part in a state where the compression mechanism according to an embodiment is lowered.
Figure 24:
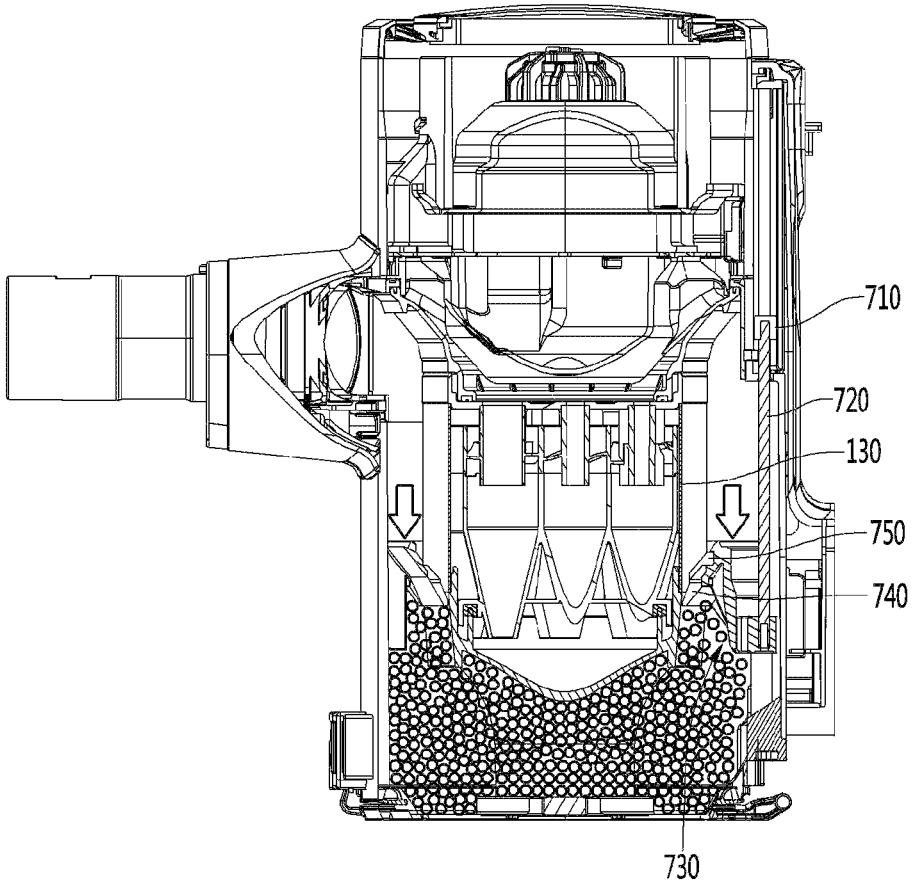
FIG. 24 is a diagram illustrating a state where a compression mechanism according to an embodiment is lowered and compresses dust in a dust container.

FIG. 23 is a diagram illustrating positions of a compression mechanism and a filter part in a state where the compression mechanism according to an embodiment is lowered, and FIG. 24 is a diagram illustrating a state where a compression mechanism according to an embodiment is lowered and compresses dust in a dust container.

Referring to FIGS. 4, 5, 23, and 24, in a state where the compression mechanism 70 moves to the standby position, the user may perform cleaning by using the cleaner 1.

Based on an operation of the suction motor 220, air and dust suctioned through the suction part 5 may be separated from each other while flowing along the inner circumference surface of the first cyclone part 110.

Dust separated from air may flow downward and may be stored in the first dust storage part 121. Air separated from dust may pass through the filter part 130, and then, may flow to the second cyclone part 140.

Dust separated from air in the second cyclone part 140 may be discharged from the second cyclone part 140, may flow downward, and may be stored in the second dust storage part 122. On the other hand, air separated from dust in the second cyclone part 140 may be discharged from the second cyclone part 140 through the discharge guide 150. Air discharged from the second cyclone part 140 may be raised by the air guide 170, and then, may pass through the suction motor 220 and may be discharged to the outside of the main body 2.

After ending of the cleaning, the user may pressurize the manipulation part 710. Therefore, the manipulation force of the manipulation part 710 may be transferred to the movable part 730 through the transfer part 720. Accordingly, the movable part 730 may be lowered by a lowering force of the manipulation part 710.

The movable part 730 may perform three functions in a process of lowering the movable part 730.

First, the movable part 730 may perform a cleaning function of the filter part 130.

The cleaning surface 741 of the cleaning part 740 may contact the filter part 130 in a process of lowering the movable part 730, and the movable part 730 may be continuously lowered in a state where the cleaning surface 741 contacts the filter part 130, whereby the filter part 130 may be cleaned by the cleaning surface 741.

Second, in a state where the body cover 114 closes a lower portion of the first body 10, the movable part 730 may compress dust in the first dust storage part 120 in a process of lowering the movable part 730.

Third, in a state where the body cover 114 opens the lower portion of the first body 10, the movable part 730 may discharge the dust, stored in the first dust storage part 120, to the outside of the first body 10 in a process of lowering the movable part 730.

Particularly, dust disposed between the filter part 130 and the inner circumference surface 101 of the first body 10 may be downward pushed by the movable part 730 and may be effectively discharged from the first body 10.

In this case, the user may lower the compression mechanism 70 a plurality of times to compress dust in a state where the body cover 114 is closed, and then, in a state where the body cover 114 is opened, the user may lower the compression mechanism 70 to allow dust to be discharged from the first body 10.

The movable part 730 may be lowered while cleaning the filter part 130, and when the movable part 730 contacts the dust stored in the first dust storage part 120 in a process of lowering the movable part 730, the movable part 730 may compress the first dust storage part 120.

As described above, in a process of lowering the movable part 730, one or more of the frame guide 765 and the pressurization rib 762 may compress the dust in the first dust storage part 120, and based on additional lowering of the movable part 730, the other portion of the movable part 730 may compress dust.

As in FIG. 23, the coupling part 764 may be substantially disposed at a lowermost portion of the frame 760. That is, since the coupling part 764 is disposed at a lower portion in the movable part 730, a distance D4 between the coupling part 764 and the manipulation part 710 may increase.

Moreover, the manipulation part 710 may be disposed close to the upper surface of the handle part 3, and thus, the distance D4 between the coupling part 764 and the manipulation part 710 may increase.

The distance D4 between the coupling part 764 and the manipulation part 710 may determine a stroke for the vertical movement of the compression mechanism 70, and when the distance D4 between the coupling part 764 and the manipulation part 710 increases, a vertical movement stroke of the compression mechanism 70 may increase.

When the vertical movement stroke of the compression mechanism 70 increases, compression performance for the dust stored in the first dust storage part 112 may be enhanced.

The elastic member 910 may contract in a process of lowering the manipulation part 710.

The horizontal-direction movement of the elastic member 910 may be limited by the supporting bar 930 in a process of contacting the elastic member 910.

In a state where the elastic member 910 contacts, when a force for manipulating the manipulation part 710 is removed, the manipulation part 710 may be raised by a restoring force of the elastic member 910. When the manipulation part 710 contacts the stopper 910 in a process of raising the manipulation part 710, raising of the manipulation part 710 may be limited.

In this case, the cleaning surface 741 of the cleaning part 740 may contact the filter part 130 in a process of raising the movable part 730, a speed at which the manipulation part 710 is raised may be reduced by a frictional force between the cleaning surface 741 and the filter part 130. Accordingly, a noise sound occurring when the stopper 910 collided with the manipulation part 710 may be reduced.

What is claimed is:

1. A cleaner comprising:

a suction part configured to suction air;

a main body comprising:

a body comprising a cyclone part configured to separate dust from the suctioned air and a dust container configured to store the separated dust, and a body cover configured to open or close a lower portion of the body;

a filter part disposed in the body and configured to filter the air which has been separated from the dust;

a movable part configured to move between an outer portion of the filter part and an inner circumference surface of the body;

a manipulation part configured to move the movable part;

a transfer part connecting the movable part to the manipulation part;

an elastic member configured to elastically support the manipulation part; and a supporting bar entirely disposed outside the dust container and coupled to the manipulation part to guide a movement of the manipulation part.

2. The cleaner of claim 1, wherein the elastic member supports the manipulation part at a position which is horizontally spaced apart from the transfer part.

3. The cleaner of claim 1, wherein, at a manipulation standby position of the manipulation part, a length of the elastic member is longer than a length of the transfer part.

4. The cleaner of claim 1, wherein the elastic member is a coil spring, and wherein the supporting bar is disposed within the coil spring.

5. The cleaner of claim 4, further comprising:

an extension body extending downward from the manipulation part and surrounding the elastic member; and a cover body supporting a lower portion of the elastic member and extending from the body to surround the lower portion of the elastic member.

6. The cleaner of claim 5, wherein, at a manipulation standby position of the manipulation part, a portion of the extension body is disposed to horizontally overlap the cover body.

7. The cleaner of claim 6, wherein a portion of the extension body is disposed within the cover body.

8. The cleaner of claim 4, further comprising a stopper extending from the body and contacting the manipulation part at a manipulation standby position of the manipulation part.

9. The cleaner of claim 8, wherein the supporting bar passes through the manipulation part and is coupled to the stopper.

10. The cleaner of claim 1, further comprising a handle part coupled to an outer portion of the body, the handle part comprising a handle body, wherein the transfer part is covered by the handle body, and wherein the elastic member is disposed outside the handle body.

11. The cleaner of claim 1, wherein the cyclone part comprises a first cyclone part configured to separate dust from the suctioned air, and a second cyclone part configured to separate dust from air discharged from the first cyclone part, and wherein the supporting bar is disposed outside the second cyclone part.

12. The cleaner of claim 11, wherein the elastic member is disposed outside the second cyclone part.

13. The cleaner of claim 1, wherein the supporting bar passes through the manipulation part.

* * * * *